US008081154B2

(12) United States Patent
Kondoh et al.

(10) Patent No.: US 8,081,154 B2
(45) Date of Patent: Dec. 20, 2011

(54) FERROELECTRIC LIQUID CRYSTAL DEVICE

(75) Inventors: Sinya Kondoh, Nishitokyo (JP); Takashi Ihara, Nishitokyo (JP)

(73) Assignee: Citizen Holdings Co., Ltd., Tokyo (JP)

( * ) Notice: Subject to any disclaimer, the term of this patent is extended or adjusted under 35 U.S.C. 154(b) by 767 days.

(21) Appl. No.: 11/724,220

(22) Filed: Mar. 15, 2007

(65) Prior Publication Data

US 2007/0216635 A1 Sep. 20, 2007

(30) Foreign Application Priority Data

Mar. 17, 2006 (JP) ..... 2006-074568

(51) Int. Cl.
*G09G 3/36* (2006.01)

(52) U.S. Cl. ..... 345/101

(58) Field of Classification Search ..... 345/87–101, 345/204–693; 359/265; 349/72; 348/244, 348/655

See application file for complete search history.

(56) References Cited

U.S. PATENT DOCUMENTS

| | | | | |
|---|---|---|---|---|
| 4,057,325 | A * | 11/1977 | Kondo | 345/101 |
| 4,687,956 | A * | 8/1987 | Itoh et al. | 327/108 |
| 5,013,137 | A * | 5/1991 | Tsuboyama et al. | 349/191 |
| 6,057,817 | A * | 5/2000 | Ono et al. | 345/94 |
| 6,710,759 | B1 | 3/2004 | Kondoh | |
| 7,928,973 | B2 * | 4/2011 | Oku et al. | 345/211 |
| 2003/0043101 | A1 * | 3/2003 | Masazumi et al. | 345/87 |
| 2003/0090442 | A1 * | 5/2003 | Hattori et al. | 345/60 |
| 2003/0214695 | A1 * | 11/2003 | Abramson et al. | 359/265 |
| 2004/0046705 | A1 * | 3/2004 | Masazumi et al. | 345/1.1 |
| 2004/0119678 | A1 * | 6/2004 | Izumi | 345/94 |
| 2006/0044482 | A1 * | 3/2006 | Shaftel | 349/33 |

FOREIGN PATENT DOCUMENTS

| | | | |
|---|---|---|---|
| JP | 06-004041 | A | 1/1994 |
| JP | 08101372 | A * | 4/1996 |
| JP | 2616496 | B2 | 4/1997 |
| JP | 2000-028996 | A | 1/2000 |
| WO | WO 00/23848 | A1 | 4/2000 |

OTHER PUBLICATIONS

Japanese Office Action dated Jun. 7, 2011, issued in corresponding Japanese Patent Application No. 2006-074568. English Translation.

* cited by examiner

*Primary Examiner* — Amr Awad
*Assistant Examiner* — Liliana Cerullo
(74) *Attorney, Agent, or Firm* — Westerman, Hattori, Daniels & Adrian, LLP

(57) ABSTRACT

There is provided a liquid crystal comprising a liquid crystal panel with a memory effect (2) sandwiching liquid crystals of a memory effect, a driving circuit (10) outputs driving voltage for driving the liquid crystal panel with a memory effect (2) and a temperature sensor for detecting an ambient temperature, wherein the driving circuit (10) includes a control circuit (11) for varying a driving voltage. The control circuit has a first temperature compensation range where the driving voltage is increased from a high temperature side toward a lower temperature side according to temperature information detected by the temperature sensor (3), and a second temperature compensation range where the driving voltage is rendered in a maximum value at a predetermined temperature, or rendered substantially equal to, or smaller than the maximum value on a side of the boundary, lower than the predetermined temperature.

12 Claims, 17 Drawing Sheets

PRIOR ART

PRIOR ART

PRIOR ART

PRIOR ART

FERROELECTRIC LIQUID CRYSTAL DEVICE

BACKGROUND OF THE INVENTION

1. Field of the Invention

The present invention relates to a liquid crystal device such as a display device, liquid crystal shutter, and so forth, for implementing stable operation by use of a liquid crystal panel, and in particular, to a liquid crystal device capable of implementing low power consumption by utilizing a memory effect owing to a bistable state of liquid crystals with a memory effect.

2. Description of the Related Art

Vigorous efforts have lately been exerted on research and development on a liquid crystal panel with a memory effect, represented by a ferroelectric liquid crystal device, and so forth, and the liquid crystal panel with a memory effect is being used in display devices, liquid crystal shutters, and the like by making the most of its feature of low power consumption. For example, International Publication No. WO 00/23848 A1 (a first embodiment, FIG. 11, and so forth) has disclosed a ferroelectric liquid crystal device capable of effecting excellent display by controlling a sticking phenomenon due to variations in threshold value of the ferroelectric liquid crystal device, and a method for driving the same. A conventional ferroelectric liquid crystal device is described hereinafter with reference to the accompanying drawings.

FIG. 11A is a schematic plan view showing a configuration of arrangement of polarizers of the ferroelectric liquid crystal device disclosed in the Patent Document described as above. In FIG. 11A, with a ferroelectric liquid crystal device 20, a liquid crystal layer 22 is disposed between a first polarizing film 21*a* and a second polarizing film 21*b*, arranged in crossed Nicols, as shown by a broken line. The liquid crystal layer 22 is disposed such that either a polarization axis A of the first polarizing film 21*a*, or a polarization axis B of the second polarizing film 21*b* is substantially parallel with a long axis direction of the molecule of the liquid crystal layer 22 at the time of liquid crystal molecules being in a first stable state (indicated by an arrow C), or in a second stable state (indicated by an arrow D). In the case of an example shown in FIG. 11A, the liquid crystal layer 22 is disposed such that the polarization axis A of the first polarizing film 21*a* is substantially parallel with the a long axis direction of the molecule at the time of the liquid crystal molecules being in the first stable state (indicated by the arrow C).

Next, FIG. 11B is a schematic sectional view showing the structure of the ferroelectric liquid crystal device 20. In FIG. 11B, the ferroelectric liquid crystal device 20 comprises the liquid crystal layer 22 composed of the liquid crystals with a memory effect having at least two stable states, and a pair of glass substrates 23*a*, 23*b*, with the liquid crystal layer 22 sandwiched therebetween. Further, the glass substrates 23*a*, 23*b* are fixedly attached to each other with a sealant 26. A plurality of scanning electrodes 24, and signal electrodes 25, serving as driving electrodes, are installed over respective surfaces of the glass substrates 23*a*, 23*b*, opposed to each other, and alignment layers 27*a*, 27*b* are vapor-deposited over the scanning electrodes 24, and the signal electrodes 25, respectively.

Further, the first polarizing film 21*a* is disposed on the outer side of the glass substrate 23*a*, on one side of the ferroelectric liquid crystal device 20, such that the polarization axis of the first polarizing film 21*a*, will be in parallel with the a long axis direction of the molecule of the liquid crystal layer 22 at the time of the liquid crystal molecules being in the first or second stable state while the second polarizing film 21*b* is disposed on the outer side of the glass substrate 23*b*, on the other side of the ferroelectric liquid crystal device 20, such that the polarization axis of the second polarizing film 21*b* will differ by 90 degrees in direction from the polarization axis of the first polarizing film 21*a*.

Now, operation of the ferroelectric liquid crystal device 20 shown in FIGS. 11A, 11B is described hereinafter. FIG. 12 is a diagram showing variation in light transmittance in relation to a driving voltage of the ferroelectric liquid crystal device 20. In this case, switching of ferroelectric liquid crystals, that is, transfer of one stable state thereof to the other stable state occurs only in the case where a voltage is applied to the ferroelectric liquid crystals when the product between a pulse width value of the driving voltage and a pulse height value thereof becomes higher than a threshold value of the ferroelectric liquid crystal device.

In FIG. 12, the ferroelectric liquid crystal device 20 makes selection on either a non-transmitting (black display) state, which is the first stable state, or a transmitting (white display) state, which is the second stable state, depending on difference in polarity of the driving voltage thereof.

In this case, a voltage value at which the light transmittance starts to vary when the driving voltage is increased in the plus direction is assumed as V1 while a voltage value at which variation of the light transmittance is saturated is assumed as V2. Then, when the driving voltage is decreased, and the driving voltage reverse in polarity is increased in the minus direction, a voltage value at which the light transmittance starts to decrease is assumed as V3 while a voltage value at which variation of the light transmittance is saturated is assumed as V4. Thus, with the ferroelectric liquid crystal device 20, if the driving voltage not lower than the threshold value of the ferroelectric liquid crystal molecules (that is, a plus applied voltage not lower than V2) is applied thereto, the second stable state is selected while if the driving voltage not lower than the threshold value of the ferroelectric liquid crystal molecules, in reverse polarity, (that is, a minus applied voltage not lower than V4) is applied thereto, the first stable state is selected. Thereafter, even if the driving voltage is turned to 0V, the respective stable states are maintained owing to the memory effect.

As a result, if the first and second polarizing films 21*a*, 21*b* are disposed as shown in FIG. 11A, the ferroelectric liquid crystal device 20 in the second stable state turns into white display (the transmitting state), and the same in the first stable state turns into black display (the nontransmitting state). Further, if the arrangement of the first and second polarizing films 21*a*, 21*b* is changed, this will enable the ferroelectric liquid crystal device 20 in the second stable state to be in the black display (the nontransmitting state), and the same in the first stable state to be in the white display (the transmitting state), however, in the present description given hereunder, it is assumed that the ferroelectric liquid crystal device 20 in the second stable state is in the white display (the transmitting state), and the same in the first stable state is in the black display (the nontransmitting state).

Now, referring to FIG. 13, there is described the driving voltage for driving the ferroelectric liquid crystal device 20. In this case, it is assumed that the ferroelectric liquid crystal device 20 is driven by, for example, a time-sharing driving system, and the driving voltage is sequentially applied by time sharing to the plurality of the scanning electrodes 24, and the signal electrodes 25. FIG. 13 shows composite driving voltages applied to the scanning electrodes 24 of the ferroelectric liquid crystal device 20, and the signal electrodes 25 thereof, respectively, and waveforms for N=1 represent the composite driving voltage applied to pixels on a first length of the scanning electrodes 24 while waveforms for N=2 represent the composite driving voltage applied to pixels on a second length of the scanning electrodes 24. Furthermore, the driving voltages in the case of the black display are shown separately from the driving voltages in the case of the white display.

Now, with the composite driving voltage for N=1, there is provided a reset time period Rs for resetting the ferroelectric liquid crystal device to either one of the stable states before a time period for writing display data. The reset time period Rs has a switching time period Sw, and a non-switching time period NSw, and during the switching time period Sw, a bipolar pulse at +Vsw and −Vsw is applied while a voltage at 0V is applied during the non-switching time period NSw. Further, a voltage whose absolute value is sufficiently larger than the previously described threshold value (that is, V2, or V4) is selected as +Vsw or −Vsw. A waveform of the driving voltages during the reset time period Rs is defined as a reset pulse.

The ferroelectric liquid crystal device 20 can be reset to the first stable state (the black display) by applying the reset pulse thereto, but it is also possible to reset ferroelectric liquid crystal device 20 to the second stable state (the white display) by inverting the reset pulse.

Subsequently, a time period immediately after the reset time period Rs is a select time period Se for writing the display data, and in the case of the black display, the bipolar pulse at ±Vse1 which is a voltage not higher than the threshold value is applied while in the case of the white display, the bipolar pulse at ±Vse2 which is a voltage not lower than the threshold value is applied. After the select time period Se, a non-select time period NSe when the bipolar pulse at ±Vnse, which is a voltage not higher than the threshold value, is applied, will continue until completion of scanning.

In the case of the composite driving voltage at N=2, a switching time period Sw of a reset time period Rs is the same in timing as the switching time period Sw for the composite driving voltage at N=1, and a select time period Se lags behind in timing by one scanning electrode. Consequently, a non-switching time period NSw varies in length by the scanning electrode, gradually increasing in length as the ordinal number of the scanning electrode increases. That is, the ferroelectric liquid crystal device 20 is driven by concurrently applying the bipolar pulse to all the pixels during the switching time period Sw of the reset time period Rs, and subsequent writing of display data to the respective scanning electrodes 24 is executed by applying the voltage after causing the select time period Se to lag behind in timing by each of the plurality of the scanning electrodes 24.

With the ferroelectric liquid crystal device, and the method for driving the same, disclosed in the Patent Document previously described, the non-switching time period NSw when a voltage 0V is applied is provided within the reset time period Rs, thereby rendering it possible to control variation in the threshold value dependent on the display state of liquid crystals, so that excellent display can be effected by controlling the sticking phenomenon.

Further, since the threshold value of a ferroelectric liquid crystal device has temperature characteristics, a method for driving the ferroelectric liquid crystal device, whereby the temperature characteristics thereof is compensated for, has been disclosed in, for example, JP 2616496 B (p. 2, FIG. 8, and so forth).

The conventional driving method for compensating for the temperature characteristics of the ferroelectric liquid crystal device is described hereinafter with reference to the accompanying drawings. FIG. 14 is a graph showing temperature compensation characteristics varying a pulse width of a driving voltage according to temperature in order to compensate for the temperature characteristics of the ferroelectric liquid crystal device. In this case, a threshold value at which the ferroelectric liquid crystal device undergoes switching has characteristics that the threshold value is small in high-temperature state, but becomes larger as temperature becomes lower.

Accordingly, as shown in the figure, the driving voltage for driving the ferroelectric liquid crystal device needs to have a large pulse width at a low temperature although a small pulse width may be sufficient at a high temperature. For example, the ferroelectric liquid crystal device can be driven with the driving voltage having a pulse width of several hundred μS at 60° C., however, at −10° C., the driving voltage having a pulse width of about 9000 μS will be required. Further, in order to effect temperature compensation for the threshold value, it is preferable to vary not only the pulse width of the driving voltage but also the pulse height of the driving voltage according to temperature, thereby effecting the temperature compensation in respect of both the pulse height and the pulse height. Thus, by varying the driving voltage according to variation in temperature, the ferroelectric liquid crystal device can be stably operated regardless of temperature.

However, it has been verified by experiment that the threshold value at which the ferroelectric liquid crystal device undergoes switching is affected by humidity as well while having the temperature characteristics.

With reference to the accompanying drawings, humidity characteristics of the ferroelectric liquid crystal device are described hereinafter. FIG. 15 is a view showing an example of the humidity characteristics of the threshold value of the ferroelectric liquid crystal device when an ambient temperature is at −10° C. and at 0° C., respectively. In the figure, the x-axis indicates an ambient humidity of the ferroelectric liquid crystal device, and the y-axis indicates a threshold value Pth of a pulse width of the driving voltage for causing the ferroelectric liquid crystal device to undergo switching.

Herein, a threshold value P1 indicated by a solid line represents the threshold value of a pulse width for causing the switching when a select voltage (5V) is applied at −10° C. while a threshold value P2 indicated by another solid line represents the threshold value of a pulse width for causing the switching when a non-select voltage (1.66 V) is applied at −10° C. Further, a threshold value P3 indicated by a broken line represents the threshold value of a pulse width for causing the switching when the select voltage (5V) is applied at 0° C. while a threshold value P4 indicated by another broken line represents the threshold value of a pulse width for causing the switching when the non-select voltage (1.66 V) is applied at 0° C.

In this case, the select voltage refers to the driving voltage applied during the select time period Se as described with reference to the composite driving voltages shown in FIG. 13, and the non-select voltage refers to the driving voltage applied during the non-select time period NSe.

Now, if attention is focused on the threshold values at −10° C., that is, P1, P2, it is shown that in high-humidity state, the threshold value P1 upon application of the select voltage is low in value while the threshold value P2 upon application of the non-select voltage is high in value. Accordingly, even if the select voltage (5V) is applied with an intermediate pulse width between the respective pulse widths of the threshold values P1, P2 to thereby, for example, invert display from black to white, and subsequently, the non-select voltage (1.66 V) with the same pulse width is applied in order to rewrite display content, the ferroelectric liquid crystal device will not undergo switching at the non-select voltage since the threshold value P2 at the non-select voltage is high in value, so that it is possible to secure a large operational margin.

However, in the case of a drop in humidity, as shown in the figure, as the humidity becomes lower, so does higher the threshold value P1 while as the humidity becomes lower, so does lower the threshold value P2. Then, the threshold values P1, and P2 intersects each other under a condition of certain humidity, and upon a further drop in humidity, relative orientations of the threshold values P1, P2 are reversed. Assuming that a point where the threshold values P1, and P2 intersects each other is referred to as an intersection K1, a region on the left side of the intersection K1, in the figure, higher in humidity than the intersection K1, is a normal operation region with a given operational margin since the threshold value P2 at the non-select voltage is higher than the threshold value P1 at the select voltage.

However, a region on the right side of the intersection K1, in the figure, lower in humidity than the intersection K1, is a region where a relationship between the threshold value P1 at the select voltage and the threshold value P2 at the non-select voltage is reversed, so that normal switching of the ferroelectric liquid crystal device cannot be implemented. This region is therefore defined as an abnormal operation region. More specifically, even if the ferroelectric liquid crystal device is caused to undergo switching at the select voltage, the ferroelectric liquid crystal device ends up undergoing switching again at the non-select voltage in the abnormal operation region because the threshold value P2 at the non-select voltage is lower than the threshold value P1 at the select voltage, so that a normal operation cannot be executed. Furthermore, in the vicinity of the boundary of the abnormal operation region even though not inside the abnormal operation region, the threshold value P1 at the select voltage is so close in value to the threshold value P2 at the non-select voltage, so that there is the risk that the operational margin decreases, thereby causing occurrence of an unstable operation.

Next, if attention is focused on the threshold values at 0° C., that is, P3, P4 it is shown that the influence of humidity is lessened, and an intersection K2 where the threshold values P3, P4 intersects each other is shifted to a point very low in humidity, so that most of an operation region falls within the normal operation region. Further, if temperature is not lower than 0° C. (not shown), the influence of humidity becomes small, and operation will be in the normal operation region regardless of a humidity level.

It has turned out from the foregoing that the threshold value of the ferroelectric liquid crystal device largely affected by humidity under a condition of the ambient temperature not higher than 0° C., and that there is a good possibility of the ferroelectric liquid crystal device finding itself within the abnormal operation region when the temperature is not higher than 0° C., and the humidity is low. Further, it is confirmed by experiment that the abnormal operation region is prone to occur when a condition of low temperature and low humidity is sustained for a given time period.

Because of a phenomenon described as above, it becomes necessary to compensate for not only the temperature characteristics but also the humidity characteristics in order to stably operate the ferroelectric liquid crystal device in a wide temperature range.

However, with the ferroelectric liquid crystal device disclosed in International Publication No. WO 00/23848 A1 as previously described, compensation for temperature and compensation for humidity have not been taken into consideration. This poses a problem in that there exists the risk of the fertoelectric liquid crystal device undergoing erroneous operation under a condition of low temperature and low humidity.

Further, with the method for driving the ferroelectric liquid crystal device disclosed in JP 2616496 B as previously described, the compensation for temperature has been taken into consideration, however, compensation for humidity has not been taken into consideration, which similarly poses the problem in that there exists the risk of the ferroelectric liquid crystal device undergoing erroneous operation under the condition of low temperature and low humidity.

Next, referring to FIGS. 16A to 17B, a conjecture is made on the principle behind the phenomenon that the ferroelectric liquid crystal device finds itself in the abnormal operation region in the case of low temperature, and low humidity. Now, FIG. 16A is a schematic view of a model representing polarities of ions in a pixel and orientation of spontaneous polarization exhibited by liquid crystal molecules, in the case where ferroelectric liquid crystals are sandwiched between a pair of glass substrates 40*a*, 40*b*, in which a black circle indicates a plus ion, and a white circle a minus ions while arrows between the black circles, and the white circles indicate the orientation of the spontaneous polarization. In FIG. 16A, an assumption is made such that a ferroelectric liquid crystal device, in a state where it is placed in an environment of low temperature and low humidity, is turned into white display representing one of the stable states when a reset pulse is applied thereto.

Since the ferroelectric liquid crystal molecules have the spontaneous polarization at this point in time, residual ionizable impurities that are present in the ferroelectric liquid crystals are attracted to the surfaces of respective alignment layers (not shown) formed on the surfaces of the glass substrates 40*a*, 40*b*, opposed to each other, by the agency of an internal electric field Eps occurring within a cell, due to the spontaneous polarization, so that the minus ions exist on a side of the cell, adjacent to the glass substrate 40*a*, and the plus ions exist on a side of the cell, adjacent to the glass substrate 40*b*. The minus ions and the plus ions create an ionic electric field Eion in such a direction as to cancel out the internal electric field Eps.

Now, in the case where SiO is used for the alignment layers, impurity ions in the liquid crystals, in a state of low temperature and low humidity, are prone to be attracted by SiO in the alignment layers, and furthermore, the impurity ions attracted to the respective alignment layers (namely, the minus ions and the plus ions) in the state of low temperature and low humidity, in particular, are in a state of extreme difficulty in their migration, so that even if the ferroelectric liquid crystal device undergoes switching by the agency of the external electric field, and the spontaneous polarization of the liquid crystal molecules is thereby inverted, the impurity ions do not follow up the liquid crystal molecules, holding a preceding state thereof.

Next, FIG. 16B is a schematic view showing a state where the ferroelectric liquid crystal device is turned into black display from a state where the white display is maintained in FIG. 16A, due to inversion of the spontaneous polarization of the liquid crystal molecules, occurring upon application of a select voltage Eout 1. In this state, the internal electric field Eps occurring due to the spontaneous polarization is inverted, however, since the ferroelectric liquid crystal device is in the state of low temperature and low humidity, the impurity ions do not follow up the liquid crystal molecules as previously described, so that there will be no change in the direction of the ionic electric field Eion.

Next, FIG. 17A is a schematic view showing a state where the impurity ions do not follow up the liquid crystal molecules, and the direction of the ionic electric field Eion is unchanged even if the black display state of the ferroelectric liquid crystal device due to inversion of the spontaneous polarization of the liquid crystal molecules continues, after completion of the application of the select voltage Eout 1. The ionic electric field Eion in this case acts so as to re-invert the spontaneous polarization of the liquid crystal molecules (to revert to a preceding state), however, because the ionic electric field Eion is not so large in intensity, the ionic electric field Eion is unable to cause instantaneous inversion of the liquid crystal molecules.

Then, FIG. 17B is a schematic view showing a state where a non-select voltage Eout 2 is applied to the liquid crystal molecules. Herein, the non-select voltage Eout 2 is a voltage lower than the select voltage Eout 1 as previously described, however, in this case, the non-select voltage Eout 2 of an electric field identical in direction to the ionic electric field Eion acts on the liquid crystal molecules, whereupon the spontaneous polarization of the liquid crystal molecules is inverted, thereby causing the ferroelectric liquid crystal device to revert to the white display. Consequently, the liquid crystal molecules will be inverted at the non-select voltage due to the effect of the ionic electric field Eion, although the non-select voltage inherently does not exceeds a voltage at the threshold value of the liquid crystal molecules, and switching does not occur at the non-select voltage.

Further, the lower temperature and humidity become, the more the impurity ions are attracted to the respective alignment layers, thereby causing the ionic electric field Eion to increase in intensity, so that the lower the temperature and the humidity become, the smaller becomes the threshold value Pth for causing the liquid crystal molecules to undergo switching, thereby increasing a possibility of erroneous operation being caused by a voltage applied during the non-select time period.

To sum up the conjecture described in the foregoing, the impurity ions are more prone to be attracted to the respective alignment layers at low temperature, and low humidity. Consequently, the ionic electric field Eion increases in intensity. Accordingly, the threshold value Pth of the pulse width during the non-select time period becomes smaller. For this reason, the threshold value Pth necessary for switching from one state such as a reset state to the other state becomes greater, but the threshold value Pth necessary for reverting to a preceding state (in this case, the voltage during the non-select time period) becomes smaller. It is presumed that owing to the above-described reason, the abnormal operation region occurs at low temperature, and low humidity.

Further, in the case where an inorganic vapor-deposited film such as an SiOx film, and so forth, susceptible to the influence of humidity, is adopted for the alignment layers, the phenomenon described as above occurs in a pronounced way. Accordingly, even in the case where material other than smectic liquid crystal such as the ferroelectric liquid crystal, and so forth is used as a liquid crystal material, it is presumed that a similar phenomenon will occur because of large influence of humidity when the inorganic vapor-deposited film is adopted for the alignment layers.

SUMMARY OF THE INVENTION

It is an object of the invention to solve the problem described as above, and to provide a liquid crystal device capable of executing temperature compensation by taking into consideration humidity characteristics of a liquid crystal panel with a memory effect, represented by a ferroelectric liquid crystal device, to thereby achieve stable operation against temperature variation, and humidity variation.

In order to attain the object described as above, a liquid crystal device according to a first aspect of the invention has the following configuration.

More specifically, there is provided a liquid crystal device capable of executing temperature compensation, comprising a liquid crystal panel with a liquid crystal layer sandwiched between a pair of substrates having respective driving electrodes, over respective surfaces of the substrates, opposed to each other, a driving circuit for outputting a driving voltage for driving the liquid crystal panel, and a temperature sensor for detecting an ambient temperature, the driving circuit including a control circuit for varying a pulse width or a pulse height of the driving voltage.

The control circuit has a first temperature compensation range where the pulse width or the pulse height of the driving voltage is increased from a high temperature side toward a low temperature side in a temperature compensation range of the liquid crystal panel, according to temperature information detected by the temperature sensor, and a second temperature compensation range where the pulse width or the pulse height of the driving voltage is rendered maximum at a predetermined temperature at the boundary between the first temperature compensation range, and the second temperature compensation range before the pulse width or the pulse height of the driving voltage is rendered substantially equal to, or smaller than a maximum pulse width or a maximum pulse height of the driving voltage, on a side of the boundary, lower than the predetermined temperature.

With the liquid crystal device, while temperature characteristics of the liquid crystal panel is compensated for on the basis of the temperature information from the temperature sensor by increasing the pulse width or the pulse height of the driving voltage from the high temperature side toward the low temperature side in the first temperature compensation range at the predetermined temperature or higher, in the second temperature compensation range on the side of the boundary, lower than the predetermined temperature, temperature compensation is executed by taking into consideration humidity characteristics of the liquid crystal panel, thereby making it possible to provide the liquid crystal device low in power consumption, capable of carrying out stable operation against temperature variation, and humidity variation.

The predetermined temperature is preferably set to a temperature not higher than 0° C.

By so doing, the temperature compensation can be executed by taking into consideration the humidity characteristics of the liquid crystal panel in the second temperature compensation range at 0° C. or lower, and an operational margin of the liquid crystal panel, in the vicinity of the boundary of an abnormal operation region, can be increased, thereby enabling stable operation to be executed.

A temperature compensation range including the first temperature compensation range and second temperature compensation range is preferably in a range of −10° C. to +60° C.

By so doing, the temperature compensation of the liquid crystal panel can be executed in a sufficiently wide temperature range from −10° C. to +60° C., so that the liquid crystal device can be suitable for outdoor application, thereby rendering it excellent in reliability.

The liquid crystals used for the liquid crystal layer of the liquid crystal device are liquid crystals with a memory effect having at least two stable states. The driving voltage preferably contains a reset pulse for resetting the liquid crystals with a memory effect to one of the two stable states, and preferably outputs the reset pulse sufficient for resetting the liquid crystals with a memory effect to the one of the two stable states in the second temperature compensation range.

The driving voltage preferably outputs the reset pulse sufficient for resetting the liquid crystals with a memory effect to the one of the two stable states at any suitable temperature in the second temperature compensation range.

More preferably, the liquid crystal device further comprises a humidity sensor for detecting an ambient humidity, and the driving circuit outputs the reset pulse sufficient for resetting the liquid crystals with a memory effect to the one of the two stable states in the second temperature compensation range on the basis of humidity information, detected by the humidity sensor.

By so doing, even if there is the risk that the liquid crystal panel with a memory effect enters the abnormal operation region in the second temperature compensation range on the side of the boundary, lower than the predetermined temperature, since the liquid crystal panel with a memory effect is pre-reset to one of the two stable states, erroneous operation can be avoided, thereby enabling reliability of the liquid crystal device to be enhanced.

Further, if the liquid crystal device is made up such that the liquid crystal panel with a memory effect is reset to one of the two stable states on the basis of the humidity information together with the temperature information, this will enable the liquid crystal panel with a memory effect to avoid entering the abnormal operation region beforehand with high precision, so that it is possible to provide a highly reliable liquid crystal device without the risk of erroneous operation.

Still further, the driving voltage applied to the liquid crystal panel with a memory effect is preferably stopped after the liquid crystal panel with a memory effect is reset.

By so doing, the liquid crystal panel with a memory effect can maintain the one of the two stable states, and at the same time, power consumption of the liquid crystal device can be checked, thereby enabling further lower power consumption to be implemented.

Yet further, the driving voltage applied to the liquid crystal panel with a memory effect may be stopped according to the humidity information detected by the humidity sensor, which is provided for detecting ambient humidity.

By so doing, it becomes possible to prevent the liquid crystal panel with a memory effect from entering the abnormal operation region beforehand with still higher precision.

The humidity information detected by the humidity sensor is preferably information on humidity at the predetermined humidity or lower.

By so doing, it becomes possible to prevent the liquid crystal panel with a memory effect from entering the abnormal operation region owing to low humidity beforehand with high precision on the basis of the information on the humidity at the predetermined humidity or lower.

Otherwise, the humidity information detected by the humidity sensor may be information on continuation of a condition of the detected humidity being at the predetermined humidity or lower for a predetermined time length.

By so doing, it becomes possible to prevent the liquid crystal panel with a memory effect from entering the abnormal operation region beforehand with still higher precision on the basis of the information on continuation of the condition of the detected humidity being at the predetermined humidity or lower for the predetermined time length.

The liquid crystal panel with a memory effect may have a liquid crystal layer preferably composed of liquid crystals exhibiting the smectic phase.

By so doing, the liquid crystal panel with a memory effect can maintain a stable state owing to memory effects of the liquid crystals exhibiting the smectic phase even if the driving voltage is stopped, so that it is possible to considerably reduce power consumption of the liquid crystal device.

The above and other objects, features and advantages of the invention will be apparent from the following detailed description which is to be read in conjunction with the accompanying drawings.

DETAILED DESCRIPTION OF THE PREFERRED EMBODIMENTS

Preferred embodiments of the invention are described hereinafter with reference to the accompanying drawings.

First Embodiment

First, a configuration of a first embodiment of a liquid crystal device according to the invention is described with reference to a block diagram shown in FIG. 1. The first embodiment of the invention has a feature such that stable operation is implemented by executing temperature compensation of a liquid crystal panel with a memory effect on the basis of temperature information detected by a temperature sensor while taking into consideration humidity characteristics of the liquid crystal panel with a memory effect, and by avoiding erroneous operation in an abnormal operation region.

Figure 1:
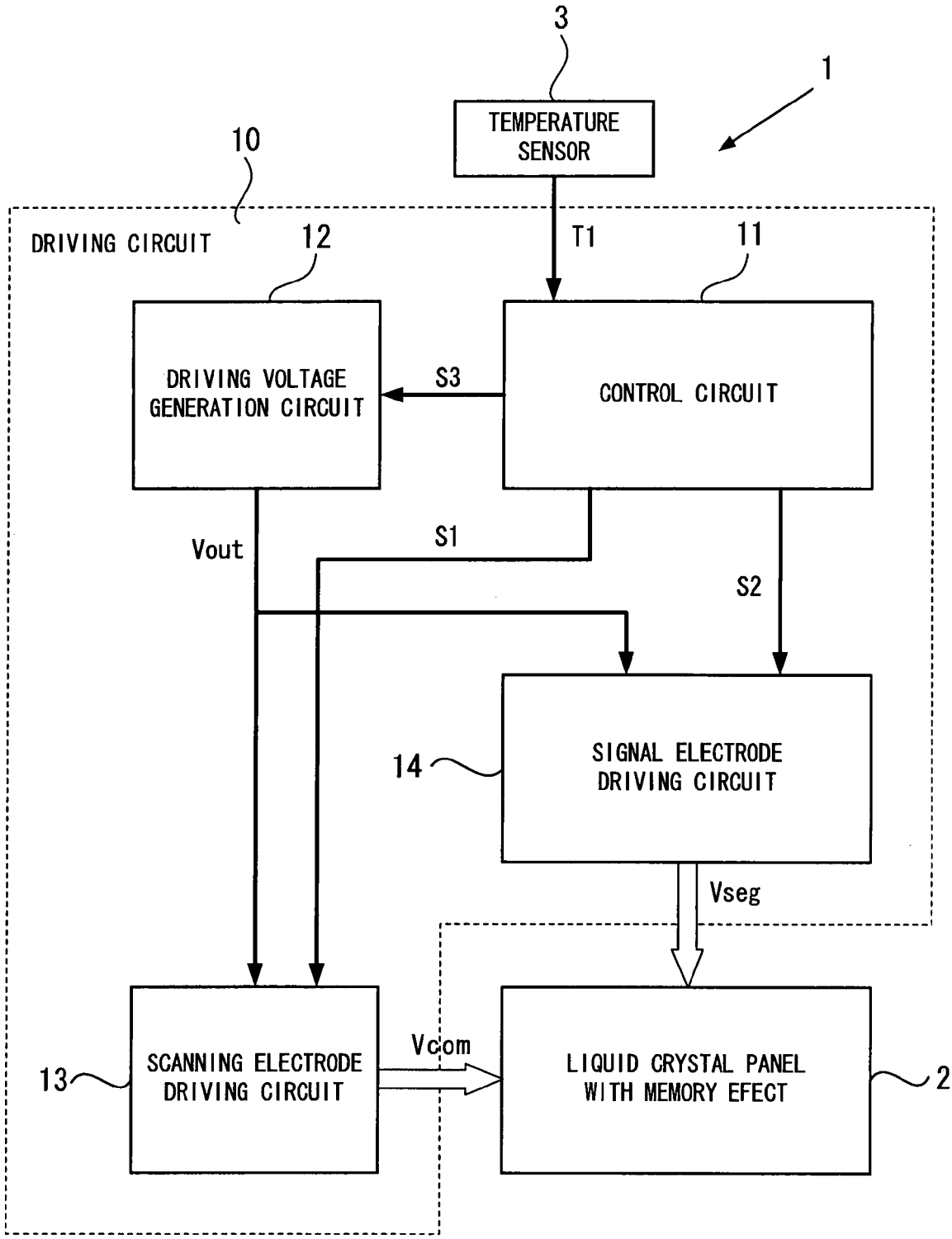
FIG. 1 is a block diagram showing a configuration of a first embodiment of a liquid crystal device according to the invention.
Figure 11A:
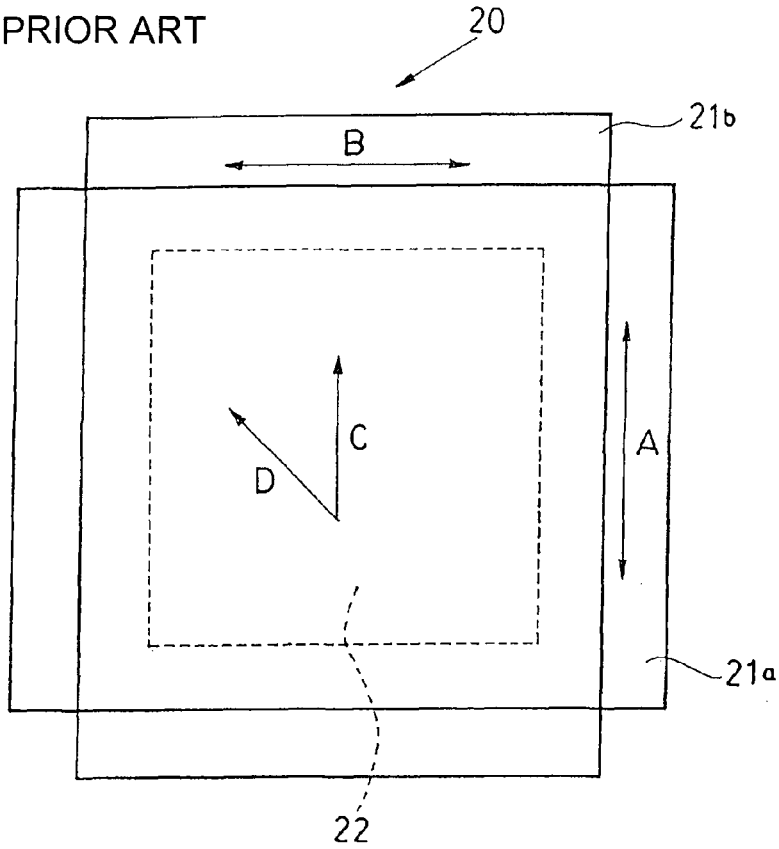
FIG 11A PRIOR ART
FIG. 11A is a schematic plan view showing a configuration of arrangement of polarizers of a conventional ferroelectric liquid crystal device.
Figure 11B:
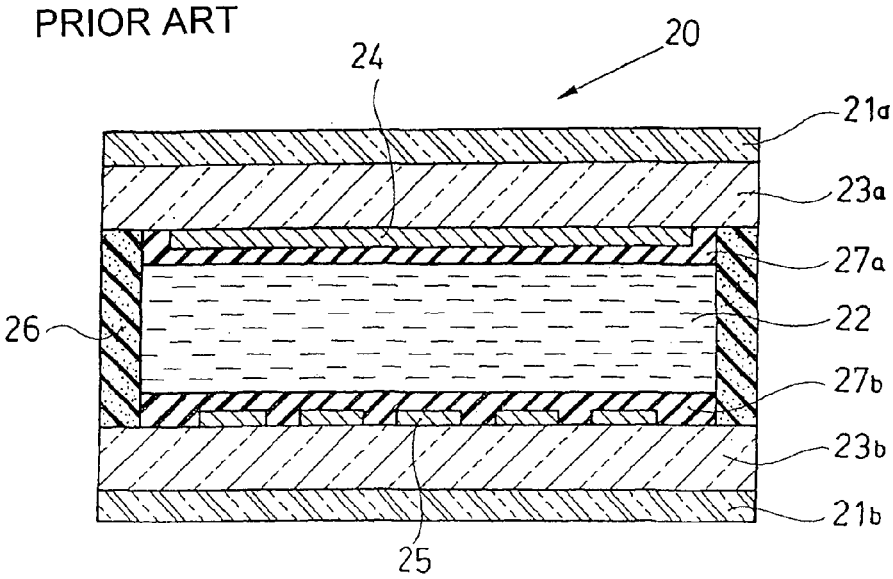
FIG. 11B PRIOR ART
FIG. 11B is a schematic sectional view showing a structure of the conventional ferroelectric liquid crystal device.
Figure 12:
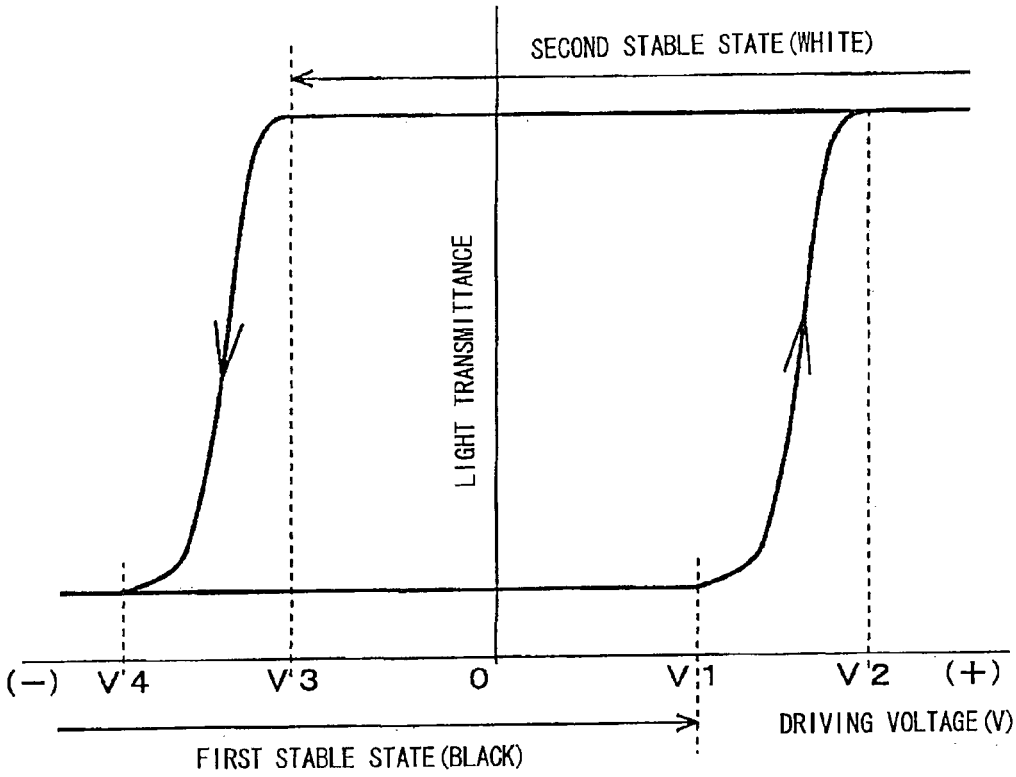
FIG. 12 is a diagram showing variation in light transmittance in relation to a driving voltage of the ferroelectric liquid crystal device.

In FIG. 1, reference numeral 1 denotes the liquid crystal device according to the first embodiment of the invention. The liquid crystal device 1 comprises a liquid crystal panel 2 with a memory effect, a temperature sensor 3, and a driving circuit 10. In this case, the liquid crystal layer of the liquid crystal panel 2 with the memory effect is composed of ferroelectric liquid crystals exhibiting the smectic phase, and the structure of the device is the same in structure as the ferroelectric liquid crystal device 20, which is described as the conventional example with reference to FIGS. 11A, 11B, omitting therefore detailed description thereof.

The temperature sensor 3 is made up of any of a thermistor having resistance whose value is variable according to an ambient temperature, an IC temperature detector for outputting a voltage corresponding to an ambient temperature, and so forth, and is capable of outputting a temperature detection signal T1 as temperature information. Further, the temperature sensor 3 may be incorporated inside an IC of a control circuit 11 described later in this description.

The driving circuit 10 comprises the control circuit 11, a driving voltage generation circuit 12, a scanning electrode driving circuit 13, and a signal electrode driving circuit 14. The control circuit 11 is for controlling the liquid crystal device 1 in whole, and is preferably made up of a microcomputer, but may be made up of a custom IC using random logic, and so forth. The control circuit 11 receives the temperature detection signal T1 from the temperature sensor 3, and outputs control signals S1, S2, S3, respectively.

Figure 13:
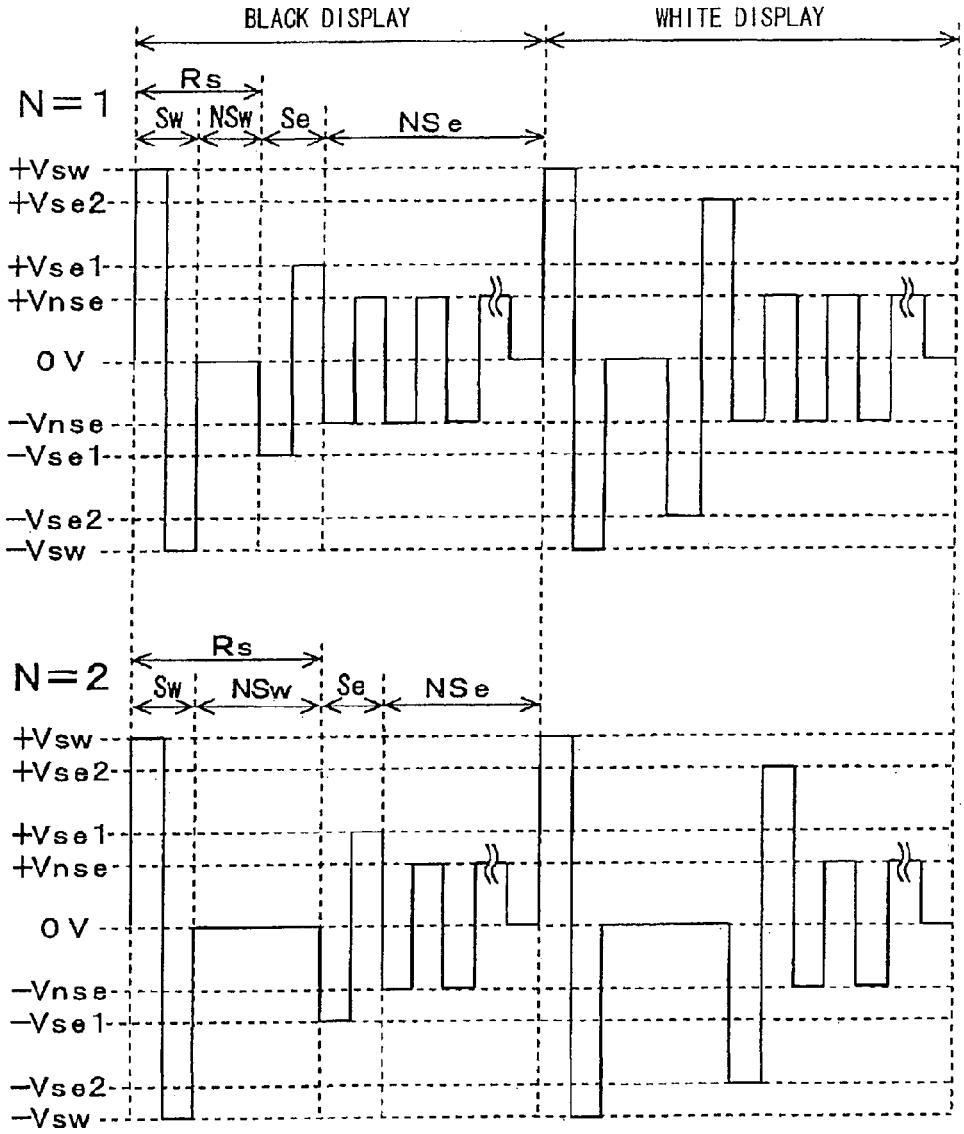
FIG. 13 is a waveform chart showing an example of a composite driving voltage applied to the ferroelectric liquid crystal device.
Figure 14:
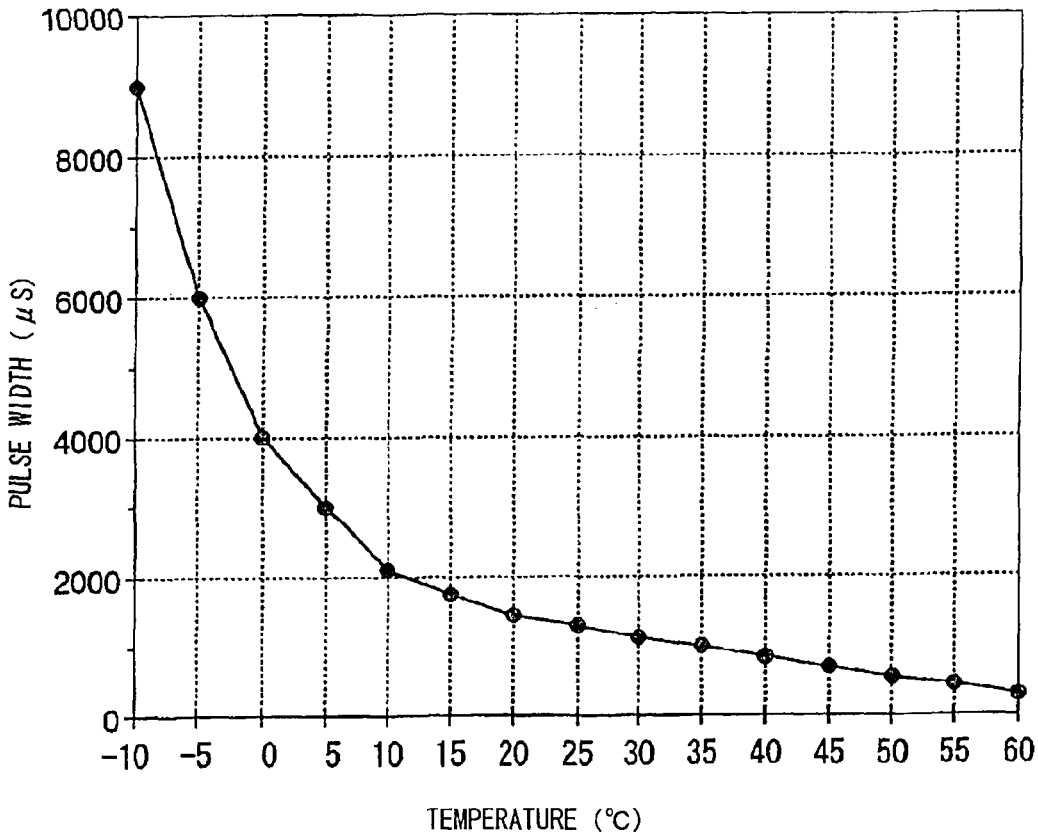
FIG. 14 is a graph showing relationship between an ambient temperature, and a pulse width of a driving voltage in the case of conventional temperature compensation.

The driving voltage generation circuit 12 receives the control signal S3 from the control circuit 11, and generates a plurality of driving voltages differing in polarity from each other in order to obtain the composite driving voltages shown in FIG. 13 to thereby output the same as an output voltage Vout. The scanning electrode driving circuit 13 is a circuit for driving the scanning electrodes (refer to FIG. 11B) of the liquid crystal panel 2 with the memory effect, and receives the output voltage Vout from the driving voltage generation circuit 12, and the control signal S1 from the control circuit 11 to thereby output a scanning electrode driving voltage Vcom. The signal electrode driving circuit 14 is a circuit for driving the signal electrodes (refer to FIG. 11B) of the liquid crystal panel 2 with the memory effect, and receives the output voltage Vout from the driving voltage generation circuit 12, and the control signal S2 from the control circuit 11 to thereby output a signal electrode driving voltage Vseg.

The liquid crystal panel 2 with the memory effect is driven upon receiving the scanning electrode driving voltage Vcom, and the signal electrode driving voltage Vseg, outputted from the driving circuit 10. A driving voltage obtained by merging the scanning electrode driving voltage Vcom with the signal electrode driving voltage Vseg corresponds to the respective composite driving voltages previously shown in FIG. 13. The driving voltage for driving the liquid crystal panel 2 with the memory effect is not limited to the respective composite driving voltages shown in FIG. 13, and may be optionally changed so as to suit the characteristics of the liquid crystal panel 2 with the memory effect, and specification of the liquid crystal device 1.

Next, a first operation of the liquid crystal device 1 according to the first embodiment is described with reference to a flow chart of FIG. 2. The first operation has a feature such that temperature characteristics of the liquid crystal panel 2 with the memory effect is compensated for by varying the driving voltage according to the temperature information detected by the temperature sensor 3, and temperature compensation is carried out by taking into consideration the humidity characteristics of the liquid crystal panel 2 with the memory effect at a temperature on the lower side of a predetermined temperature. The present description is based on the premise that the liquid crystal device 1 is a display device for effecting display of time and so forth by means of the liquid crystal panel 2 with the memory effect.

Figure 2:
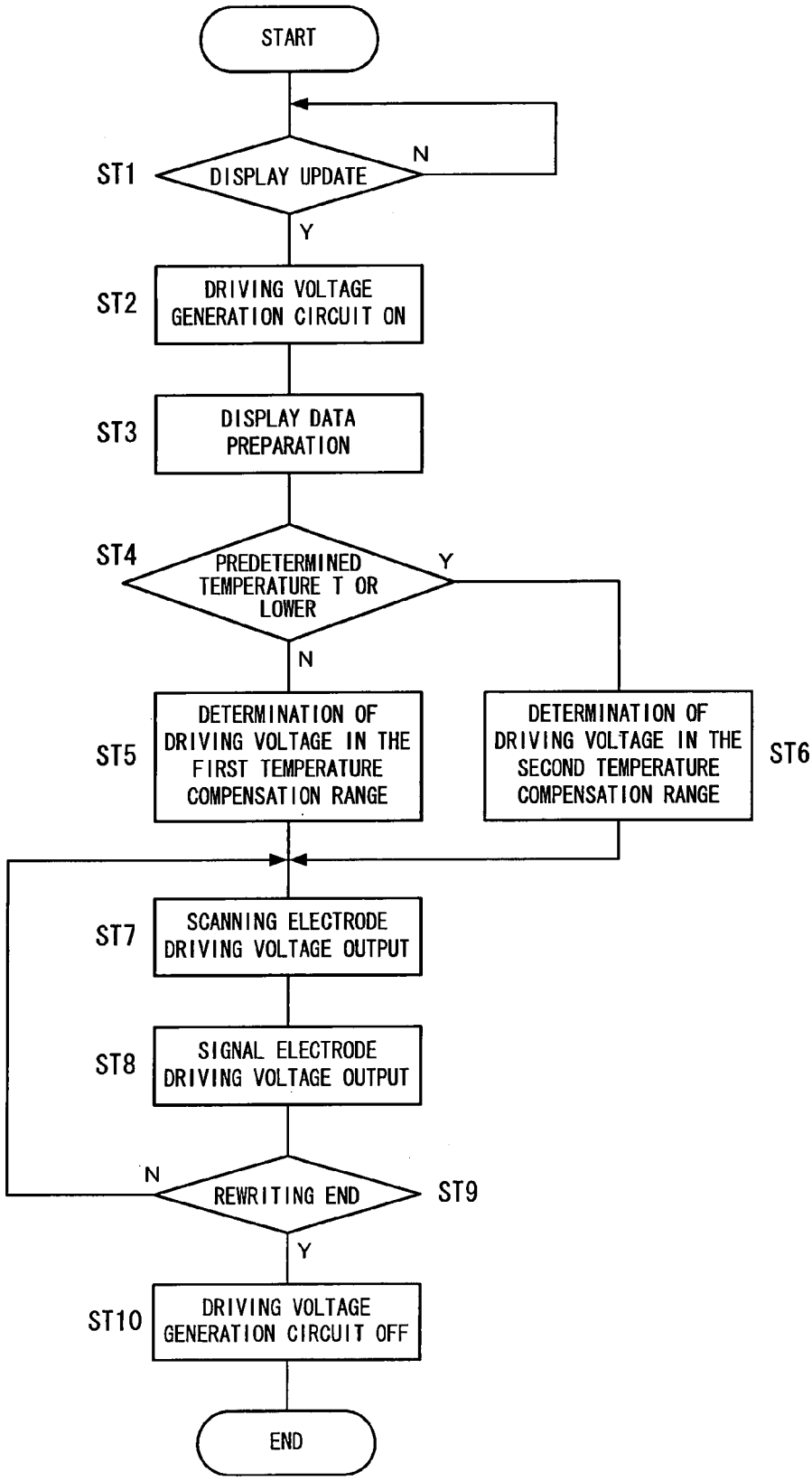
FIG. 2 is a flow chart showing a first operation of a driving circuit of the liquid crystal device.

With reference to the flow chart of FIG. 2, first, in step ST1, the control circuit 11 made up of the microcomputer, and so forth, as constituents of the driving circuit 10 shown in FIG. 1, determines whether to update a display on the liquid crystal panel 2 with the memory effect or not. In this case, for updating display content, in the case of the liquid crystal device 1 being, for example, the display device for indicating a digital time in hours and minutes, it is necessary to update a display when time advances at places for minutes. It is also necessary to update a display, for example, in the case of a user switching a display mode by actuating a switch (not shown), and so forth. If determination Yes is made by the control circuit 11 in the step ST1, the operation proceeds to the next step ST2 while if determination No is made, the operation reverts to the step ST1, holding a standby state until updating of the display.

In the step ST2, the control circuit 11 outputs the control signal S3 to thereby turn ON the driving voltage generation circuit 12, which in turn outputs the output voltage Vout.

Next, in step ST3, the control circuit 11 stores display data to be updated in a built-in memory (not shown) to prepare for outputting the display data. For example, if time advances from 11:59 a.m. to 12:00 a.m., the control circuit 11 causes the built-in memory to store 12:00 a.m. as the display data to thereby prepare for outputting the display data.

Next, in step ST4, the control circuit 11 receives the temperature detection signal T1, which is an analog signal from the temperature sensor 3, to thereby convert the temperature detection signal T1 into digital information through an internal A/D converter (not shown), and subsequently, compares the digital information with a predetermined temperature T as preset, thereby determining whether or not a detected temperature is equal to the predetermined temperature T or lower. Herein, the predetermined temperature T refers to a temperature at the boundary between a first temperature compensation range, and a second temperature compensation range, both the ranges being capable of compensating for the temperature characteristics of the liquid crystal panel 2 with the memory effect. If determination No is made in the step ST4, the operation proceeds to step ST5 while if determination Yes is made in the step ST4, the operation proceeds to step ST6.

Accordingly, if the detected temperature is higher than the predetermined temperature T, the operation proceeds to the step ST5, and the control circuit 11 makes a decision on a pulse width or a pulse height of the scanning electrode driving voltage Vcom and the signal electrode driving voltage. Vseg, respectively, according to the temperature information as detected, by referring to a pulse width table or a pulse height table, pre-stored, in the first temperature compensation range.

Further, if the detected temperature is lower than the predetermined temperature T, the operation proceeds to the step ST6, and the control circuit 11 makes a decision on a pulse width or a pulse height of the scanning electrode driving voltage Vcom, and the signal electrode driving voltage Vseg, respectively, according to the temperature information as detected, by referring to a pulse width table or a pulse height table, pre-stored, in the second temperature compensation range.

Thereafter, in step ST7, the control circuit 11 outputs the control signal S1 to thereby control the scanning electrode driving circuit 13, and cause the scanning electrode driving circuit 13 to output the scanning electrode driving voltage Vcom on the basis of the pulse width or the pulse height, as decided, thereby selecting one line of the scanning electrodes of the liquid crystal panel 2 with the memory effect.

Next, in step ST8, the control circuit 11 outputs the control signal S2 on the basis of the display data as previously prepared to thereby control the signal electrode driving circuit 14, causing the signal electrode driving circuit 14 to output the signal electrode driving voltage Vseg on the basis of the pulse width or the pulse height, as decided. In the step ST8, pixels on the line of the scanning electrodes, selected in the step ST7, are written based on the display data.

Next, in step ST9, the control circuit 11 determines whether or not rewriting to one entire frame of the liquid crystal panel 2 with the memory effect has been completed. If the determination in the step ST9 is Yes, the operation proceeds to step ST10 while if the determination in this step is No, the operation reverts to the step ST7, sequentially outputting the scanning electrode driving voltage Vcom, and the signal electrode driving voltage Vseg, corresponding to the next scanning electrode, respectively. By repeating the steps ST7, ST8, and ST9, the driving voltage sufficient for one frame is supplied to the liquid crystal panel 2 with the memory effect, so that new display content is written to all the pixels of the liquid crystal panel 2 with the memory effect, thereby updating the display.

Then, the control circuit 11 makes the determination Yes in the step ST9, and the operation proceeds to step ST10, whereupon the control circuit 11 controls the scanning electrode driving circuit 13 and the signal electrode driving circuit 14 by the agency of the control signal S1 and the control signal S2, respectively, to stop outputting by the scanning electrode driving voltage Vcom and the signal electrode driving voltage Vseg, respectively, thereby completing writing to the liquid crystal panel 2 with the memory effect. Further, the control circuit 11 outputs the control signal S3 to turn OFF the driving voltage generation circuit 12, thereby stopping outputting the output voltage Vout as well.

After the completion of the processing in the step ST10, the control circuit 11 falls in pause state, and the driving voltage generation circuit 12, the scanning electrode driving circuit 13 and the signal electrode driving circuit 14 are all in pause state, whereupon supply of the driving voltage to the liquid crystal panel 2 with the memory effect is stopped, so that power consumption during a time period of the pause becomes very low. However, it goes without saying that in the case of the liquid crystal panel 2 with the memory effect, the display can be maintained owing to the memory effect thereof even if the supply of the driving voltage thereto is stopped.

Next, an example of the driving voltage controlled by the first operation according to the first embodiment is described with reference to FIG. 3. Now, the present description is based on the premise that the scanning electrode driving voltage Vcom and the signal electrode driving voltage Vseg, serving as the driving voltage, has the pulse width or the pulse height, variable according to temperature, however, with the present embodiment, the temperature compensation is executed by varying the pulse width.

Figure 3:
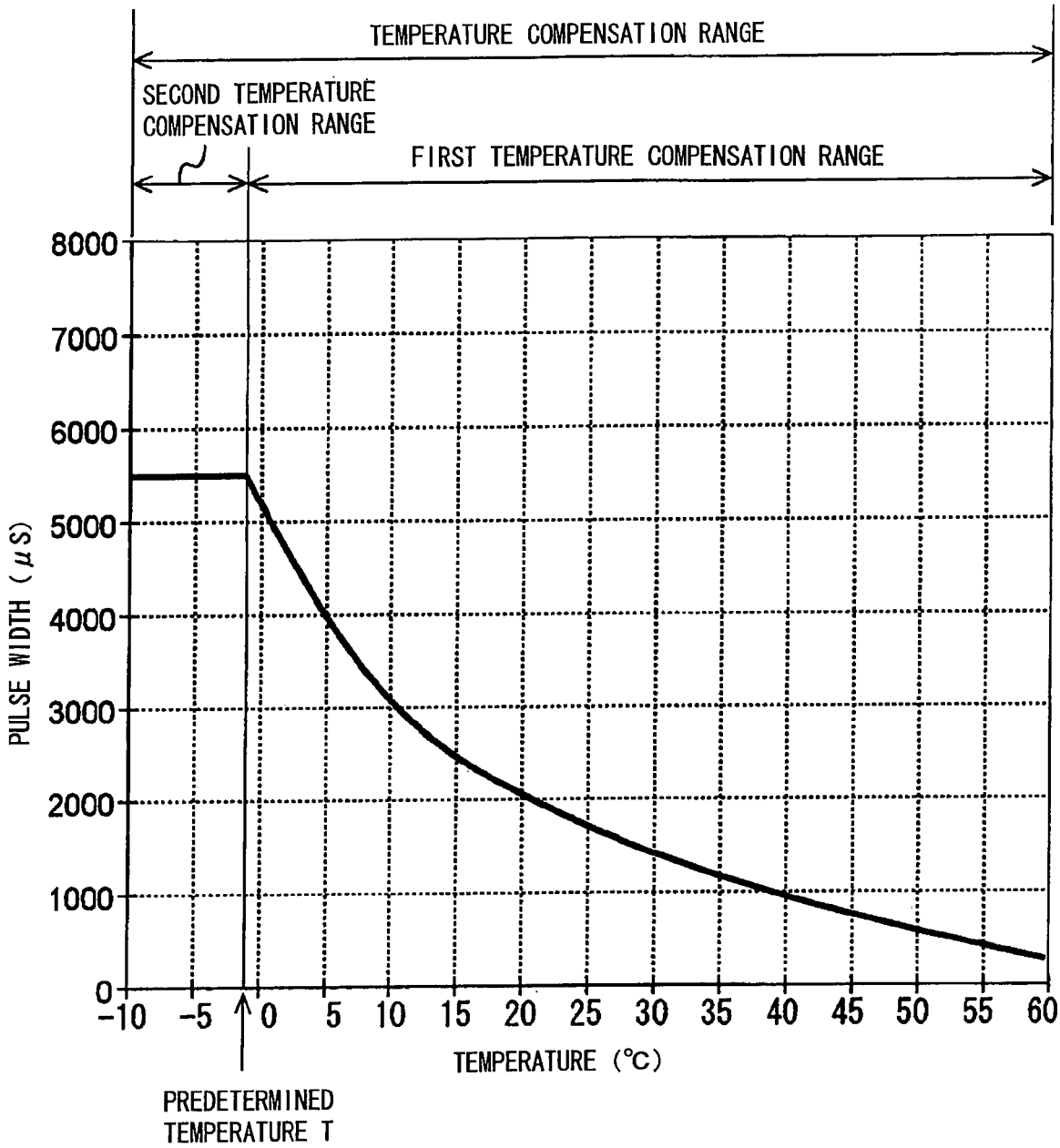
FIG. 3 is a graph showing an example of a relationship between an ambient temperature, and a pulse width of a driving voltage with reference to the first operation.

In FIG. 3, the X-axis indicates detected temperature, and the Y-axis indicates the pulse width of the driving voltage (namely, the composite driving voltage obtained by merging the scanning electrode driving voltage Vcom with the signal electrode driving voltage Vseg) during the select time period Se (refer to FIG. 13).

Herein, the predetermined temperature T is a temperature at the boundary between the first temperature compensation range, and the second temperature compensation range, and is preferably not higher than 0° C. from the viewpoint of the characteristics of the liquid crystal panel 2 with the memory effect, and is assumed at about −2° C. in this case. If the detected temperature is higher the predetermined temperature T (about −2° C.), the detected temperature falls in the first temperature compensation range as shown in the figure, and if the detected temperature is lower than the predetermined temperature T (about −2° C.), the detected temperature falls in the second temperature compensation range. An overall temperature compensation range including the first temperature compensation range and second temperature compensation range is preferably in a range of +60° C. to −10° C. This view is based on the assumption that the liquid crystal device according the invention is mounted in a wristwatch, portable electronic equipment, and so forth for outdoor application, however, the overall temperature compensation range may be optionally set according to the specification of equipment in which the liquid crystal device is mounted.

Now, in the case where the detected temperature found by the temperature sensor 3 is in the first temperature compensation range, the pulse width of the driving voltage increases from a high temperature side toward a low temperature side, reaching its maximum (about 5500 μS) at the predetermined temperature T. As for pulse width values in the first temperature compensation range, increments of the pulse width are decided by referring to the pulse width table for the first temperature compensation range, stored in the memory (for example, ROM) of the control circuit 11.

An increment curve of the pulse width is decided on the basis of the temperature characteristics of the threshold value of the liquid crystal panel 2 with the memory effect, in the first temperature compensation range (that is, from +60° C. to the predetermined temperature T), and by utilizing the increment curve of the pulse width, it is possible to compensate for display operation of the liquid crystal panel 2 with the memory effect, in the first temperature compensation range, thereby achieving stable operation in relation to temperature.

Further, in the case where the detected temperature found by the temperature sensor 3 is in the second temperature compensation range, the pulse width of the driving voltage becomes substantially equal to a maximum pulse width reached at the predetermined temperature T. Values of the pulse widths in the second temperature compensation range are decided by referring to the pulse width table for the second temperature compensation range, stored in the memory of the control circuit 11.

Figure 15:
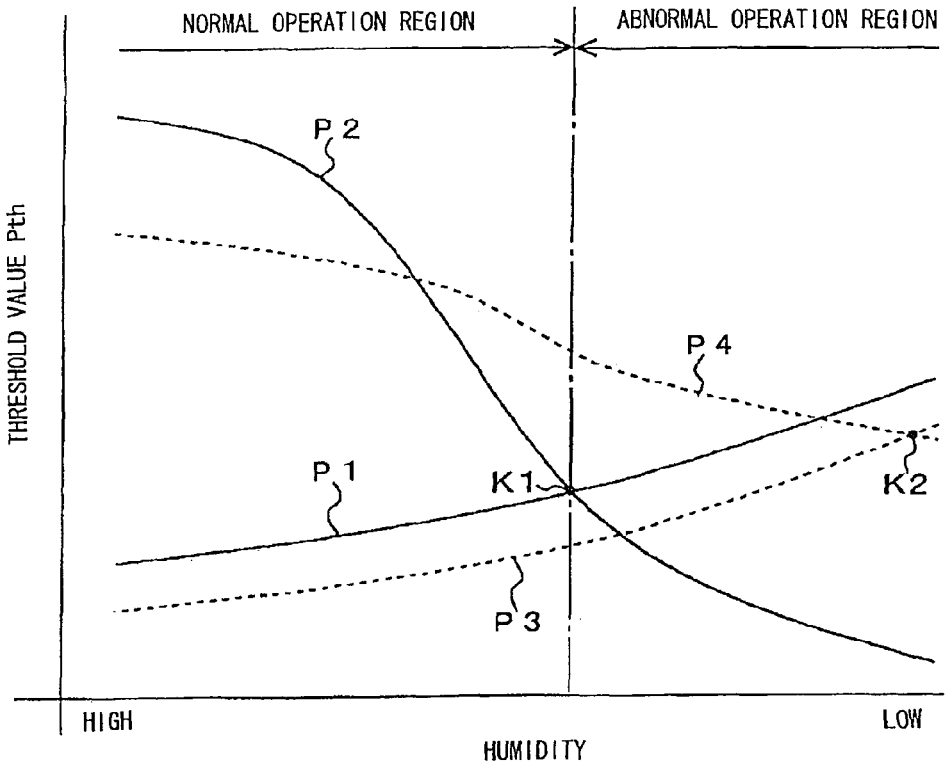
FIG. 15 PRIOR ART
FIG. 15 is a view showing humidity characteristics of threshold values of the driving voltage, causing the ferroelectric liquid crystal device to undergo switching.
Figure 16A:
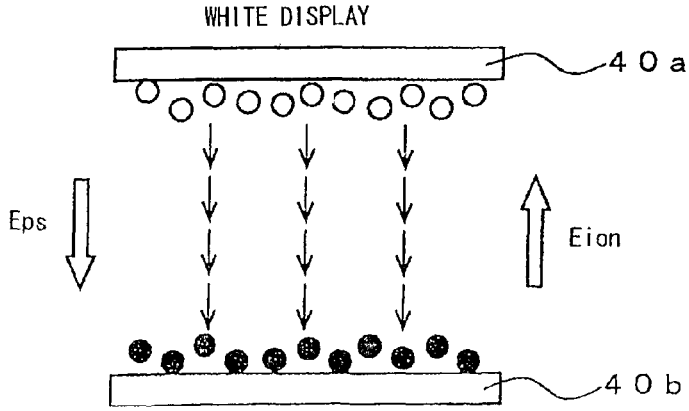
FIG. 16A PRIOR ART
FIGS. 16A, 16B, 17A, 17B each are a schematic view for describing the action of the ferroelectric liquid crystal device entering an abnormal operation region.
Figure 16B:
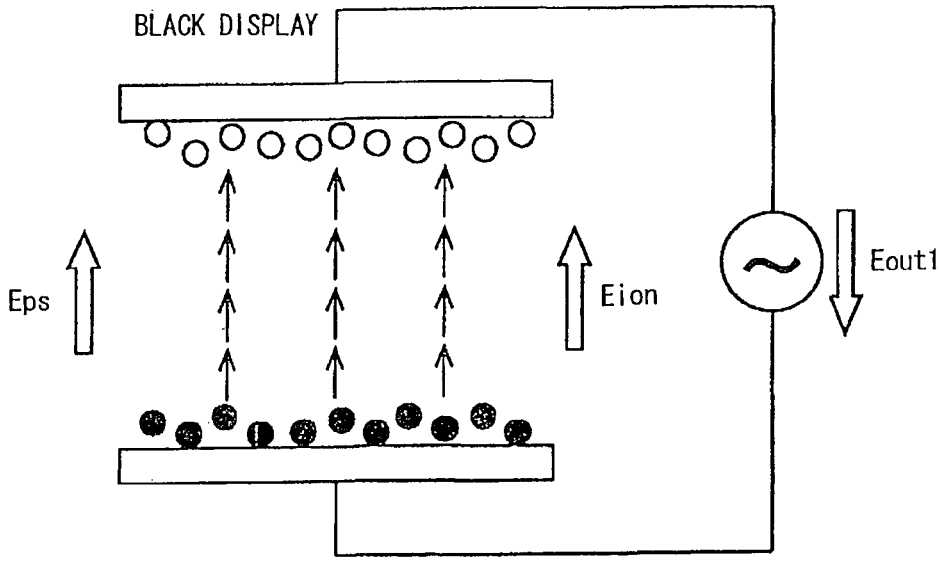
FIG. 16B PRIOR ART
Figure 17A:
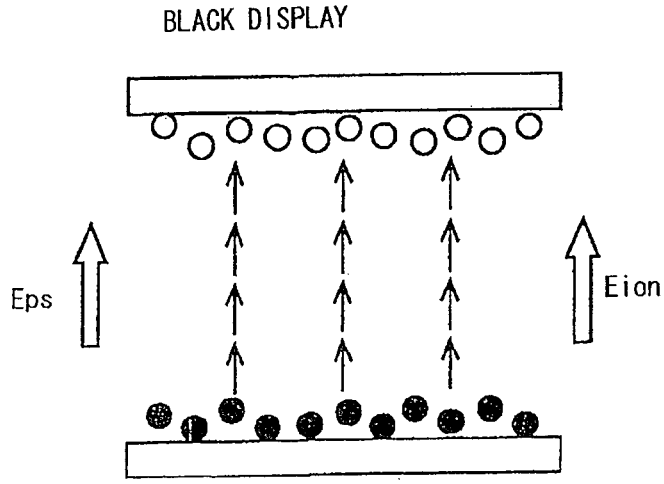
FIG. 17A PRIOR ART
Figure 17B:
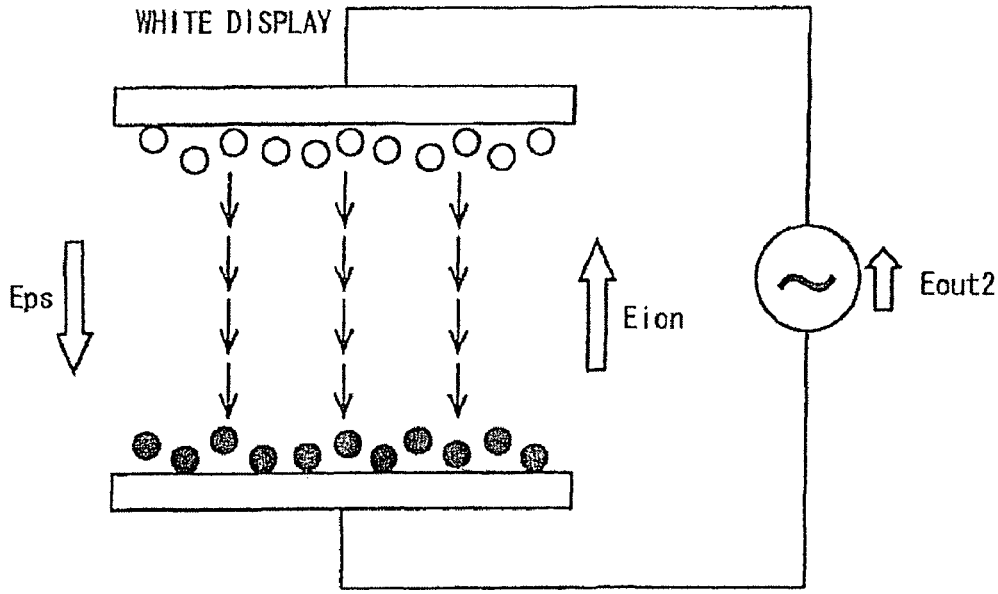

The reason why the pulse width in the second temperature compensation range is substantially equal to the pulse width at the predetermined temperature T can be explained on the basis of the humidity characteristics of the threshold value of the ferroelectric liquid crystal device, previously described with reference to FIG. 15. More specifically, at low humidity, the threshold value P2 of the pulse width of the driving voltage when the non-select voltage is applied at −10° C. becomes considerably smaller as compared with the threshold value P4 of the pulse width of the driving voltage when the non-select voltage is applied at 0° C., as previously described with reference to FIG. 15, so that the abnormal operation region is prone to occur.

For this reason, if the pulse width of the driving voltage is increased according to a decrease in temperature, as in the first temperature compensation range, at a temperature where the abnormal operation region is prone to occur (namely, at 0° C. or lower), this will cause a decrease in the operational margin of the liquid crystal panel 2 with the memory effect contrary to the case of the detected temperature being in the first temperature compensation range, thereby rendering erroneous operation prone to occur. Accordingly, by keeping the pulse width in the second temperature compensation range substantially equal to the pulse width at the predetermined temperature T, and by preventing the pulse width from increasing any further, it is possible to secure a given operational margin to thereby attain stable operation even if the threshold value of the pulse width of the driving voltage rapidly drops at a low humidity when the non-select voltage is applied at 0° C. or lower.

Figure 4:
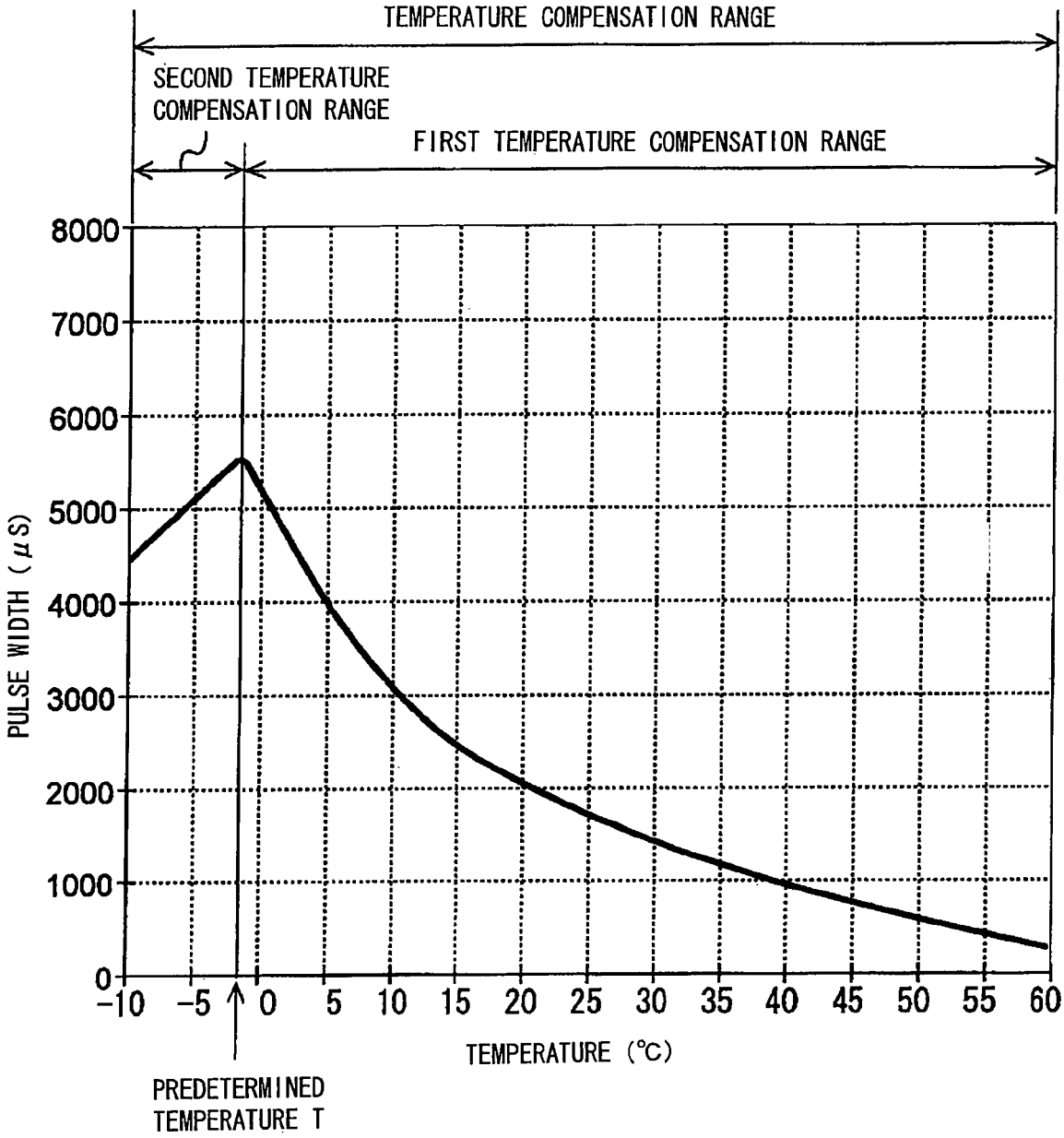
FIG. 4 is a graph showing another example of the relationship between the ambient temperature, and the pulse width of the driving voltage with reference to the first operation.

Next, another example of the driving voltage controlled by the first operation (refer to the flow chart of FIG. 2) according to the first embodiment is described with reference to FIG. 4. Herein, the present description is based on the premise that the temperature compensation of the driving voltage is executed by varying the pulse width as with the case shown in FIG. 3. In FIG. 4, the X-axis indicates detected temperature, and the Y-axis indicates the pulse width of the driving voltage (namely, the composite driving voltage obtained by merging the scanning electrode driving voltage Vcom with the signal electrode driving voltage Vseg) during the select time period Se (refer to FIG. 13).

Herein, the predetermined temperature T at the boundary between the first temperature compensation range, and the second temperature compensation range is preferably not higher than 0° C. from the viewpoint of the characteristics of the liquid crystal panel 2 with the memory effect, and is assumed at about −2° C. in this case. If the detected temperature is higher the predetermined temperature T (about −2° C.), the detected temperature falls in the first temperature compensation range as shown in the figure, and if the detected temperature is lower than the predetermined temperature T (about −2° C.), the detected temperature falls in the second temperature compensation range. The overall temperature compensation range including the first temperature compensation range and second temperature compensation range is preferably in a range of +60° C. to −10° C.

In the case where the detected temperature found by the temperature sensor 3 is in the first temperature compensation range, the pulse width of the driving voltage increases from the high temperature side toward the low temperature side as with the case shown in FIG. 3, omitting therefore description thereof. In the case where the detected temperature found by the temperature sensor 3 is in the second temperature compensation range, the pulse width of the driving voltage becomes smaller than the maximum pulse Width reached at the predetermined temperature T, and the pulse width decreases following a drop in temperature. Pulse width values in the second temperature compensation range are decided by referring to the pulse width table for the second temperature compensation range, stored in the memory of the control circuit 11.

Now, the reason why the pulse width of the driving voltage, in the second temperature compensation range, is set so as to be at its maximum at the predetermined temperature T, and to be rendered smaller at a temperature lower than the predetermined temperature T can be explained on the basis of the humidity characteristics of the threshold value of the ferroelectric liquid crystal device, previously described with reference to FIG. 15. More specifically, at low humidity, the threshold value P2 of the pulse width of the driving voltage when the non-select voltage is applied at −10° C. becomes considerably smaller as compared with the threshold value P4 of the pulse width of the driving voltage when the non-select voltage is applied at 0° C., as previously described with reference to FIG. 15.

Thus, in a condition of the temperature at 0° C. or lower, and low humidity, the lower the temperature, the smaller becomes the threshold value of the pulse width of the driving voltage when the non-select voltage is applied, so that it follows that the temperature characteristics of the threshold value of the ferroelectric liquid crystal device have an inclination reverse to that for the temperature characteristics of the threshold value in the first temperature compensation range.

Accordingly, by focusing attention on the fact that the pulse width of the driving voltage in the second temperature compensation range at the predetermined temperature T or lower, shown in FIG. 4, has temperature characteristics of the threshold value thereof, reversed in the inclination, an inclination of variation in the pulse width in the second temperature compensation range is reversed from that for the first temperature compensation range, along the temperature characteristics of the threshold value at low humidity.

By so doing, it is possible to increase the operational margin of the liquid crystal panel 2 with the memory effect in an environment at low temperature and low humidity in the case of a compensation curve by the driving voltage being as shown in FIG. 4 more than the case of a compensation curve by the driving voltage being as shown in FIG. 3, thereby enabling the operation of the liquid crystal device to be more stabilized.

Further, it is to be pointed out that the inclination of the pulse width of the driving voltage in the second temperature compensation range is not limited to that shown in FIG. 4 as an example, and may be optionally decided so as to suit the characteristics of the liquid crystal panel 2 with the memory effect.

Next, a second operation of the liquid crystal device 1 according to the first embodiment is described with reference to a flow chart of FIG. 5. The second operation has a feature such that the liquid crystal panel 2 with the memory effect is reset at an optional temperature lower than the predetermined temperature T in order to avoid erroneous operation of the liquid crystal device 1, in the abnormal operation region. As with the first operation, the present description is based on the premise that the liquid crystal device 1 is the display device for effecting display of time and so forth by means of the liquid crystal panel 2 with the memory effect.

Figure 5:
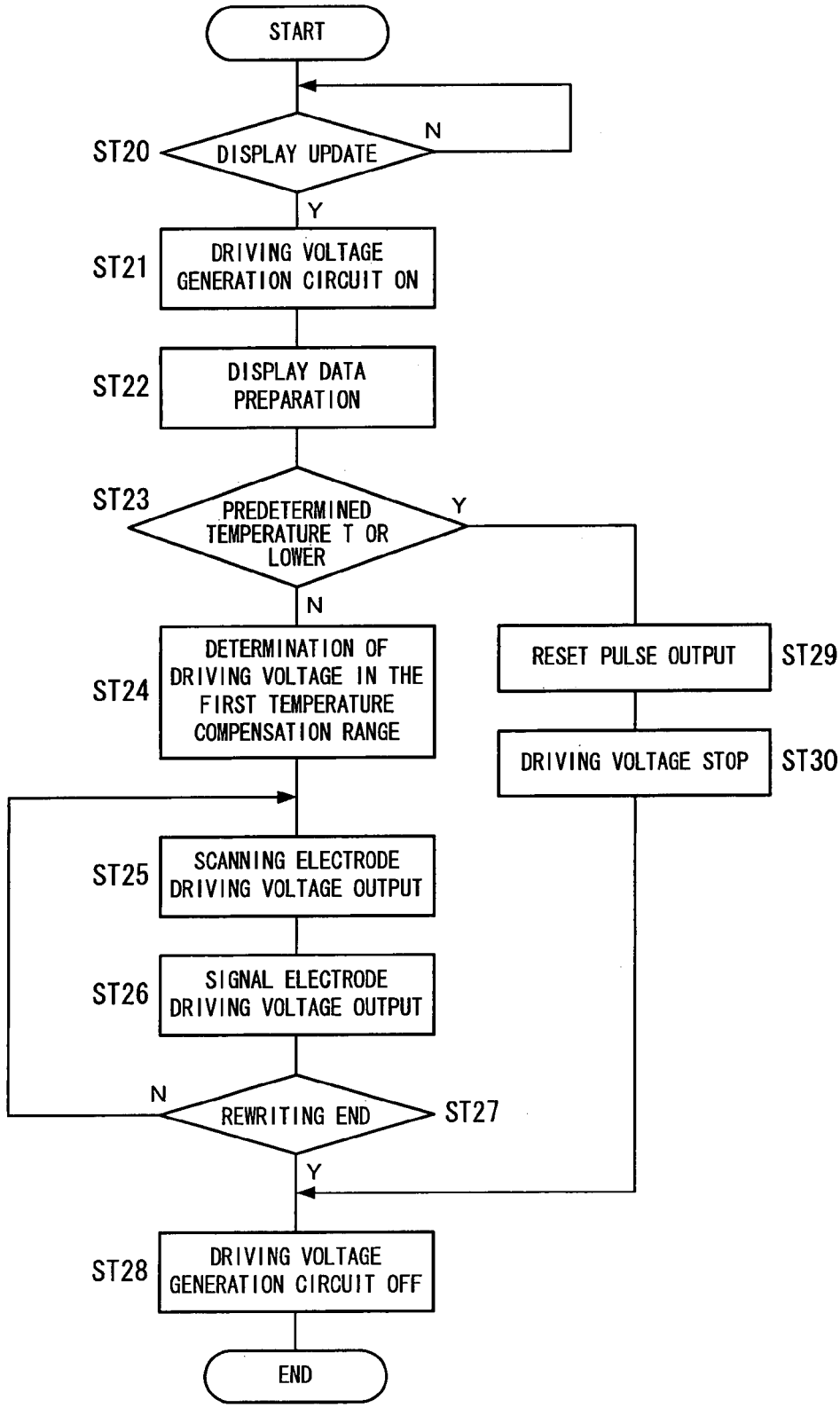
FIG. 5 is a flow chart showing a second operation of the driving circuit in FIG. 1.

With reference to the flow chart of FIG. 5, first, in step ST20, the control circuit 11 made up of the microcomputer, and so forth, as the constituents of the driving circuit 10 shown in FIG. 1, determines whether to update a display on the liquid crystal panel 2 with the memory effect or not. In this case, for updating display content, the same operation as that described in the case of the first operation is executed.

Then, in the case where determination to update a display is made, processing by the control circuit 11, in steps ST 21 to ST 23, respectively, is identical to that in the steps ST2 to ST4, respectively, shown in the flow chart of FIG. 2, described with reference to the first operation, omitting therefore description thereof.

If the detected temperature is higher than the predetermined temperature T, in the step ST23, the control circuit 11 determines that the detected temperature is not at the predetermined temperature T or lower (No), whereupon the operation proceeds to the step ST24 to makes a decision on a pulse width or a pulse height of the scanning electrode driving voltage Vcom and the signal electrode driving voltage Vseg, respectively, according to the temperature information as detected, by referring to a pulse width table or a pulse height table, for the first temperature range, prestored in the memory.

Thereafter, control processing by the control circuit 11, in steps ST 25 to ST28, respectively, is identical to that in the steps ST7 to ST10, respectively, shown in the flow chart of FIG. 2, described with reference to the first operation, omitting therefore description thereof.

Next, the case where the detected temperature is lower than the predetermined temperature T is described hereinafter. In this case, in the step ST23, the control circuit 11 determines that the detected temperature is lower than the predetermined temperature T (Yes), whereupon the operation proceeds to the step ST29. And, the control circuit 11 outputs the control signals S1, S2 to control the scanning electrode driving circuit 13, and the signal electrode driving circuit 14, respectively, thereby causing a reset pulse to be outputted by the scanning electrode driving voltage Vcom and the signal electrode driving voltage Vseg, respectively.

The reset pulse is the same as the reset pulse (refer to FIG. 13) bidirectionally outputted in the switching time period Sw of the reset time period Rs for setting all the pixels in the black display state, ands is preferably at a voltage sufficient to reset the liquid crystal panel 2 with the memory effect into one of the stable states. Further, with the example shown in the flow chart of FIG. 5, the reset pulse is outputted immediately at a point in time when the detected temperature is turned to the predetermined temperature T or lower, however, a temperature at which the reset pulse is outputted may be any suitable temperature in the second temperature compensation range, according to the characteristics of the liquid crystal panel 2 with the memory effect.

In step ST30 after completion of processing in the step ST29, the control circuit 11 controls the scanning electrode driving circuit 13, and the signal electrode driving circuit 14, by the agency of the control signals S1, S2, respectively, so as to stop outputting the scanning electrode driving voltage Vcom and the signal electrode driving voltage Vseg, thereby stopping application of the driving voltage to the liquid crystal panel 2 with the memory effect. Subsequently, processing in the step ST28 is executed to thereby complete the operation for updating the display.

After completion of the operation in the step ST28, the control circuit 11 falls in pause state, and the driving voltage generation circuit 12, the scanning electrode driving circuit 13 and the signal electrode driving circuit 14 are all in pause state, whereupon supply of the driving voltage to the liquid crystal panel 2 with the memory effect is stopped, so that power consumption during a time period of the pause becomes very small. However, with the liquid crystal panel 2 with the memory effect, a reset display state (that is, black display) can be maintained owing to the memory effect even if the supply of the driving voltage thereto is stopped.

Figure 6:
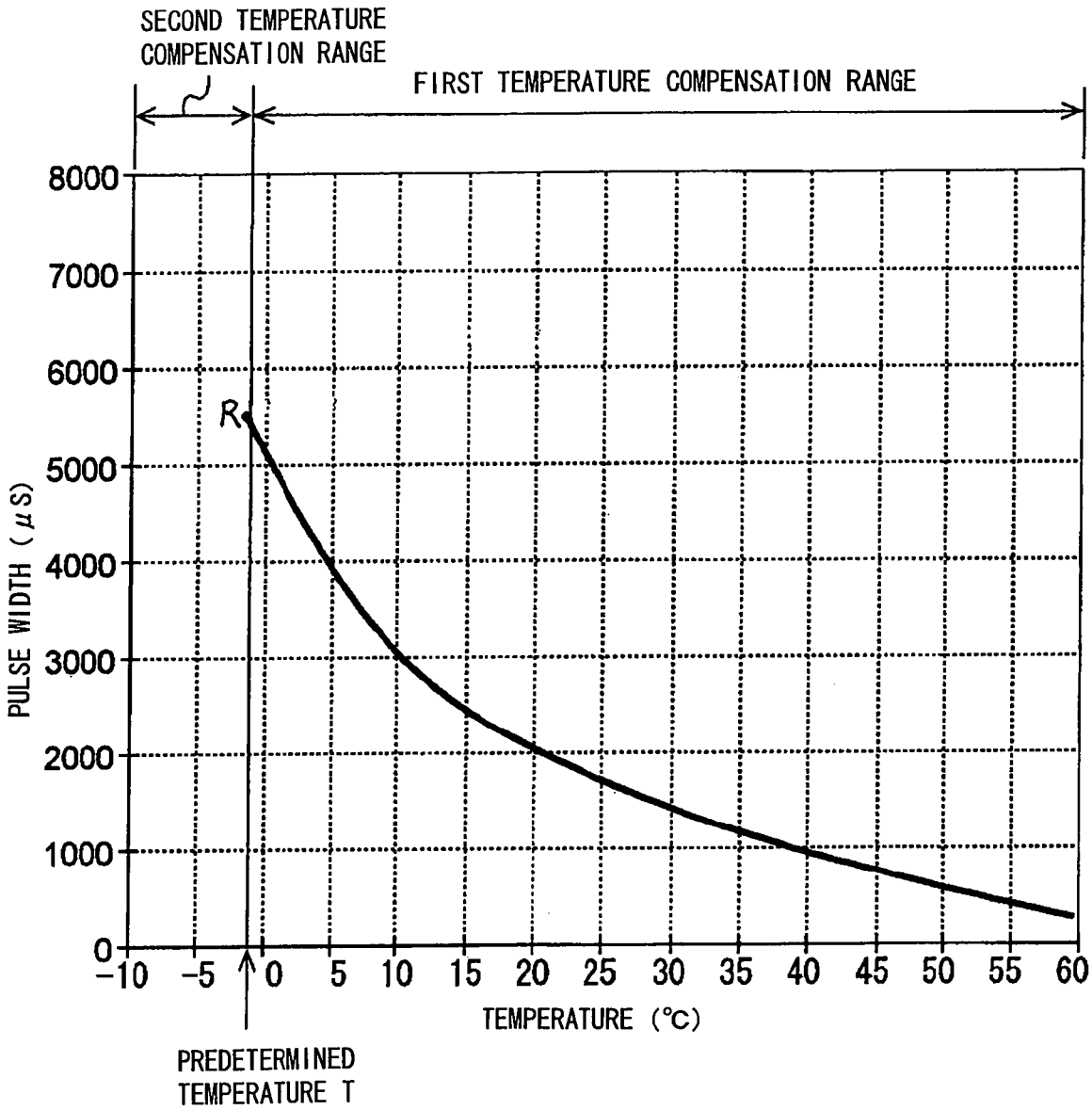
FIG. 6 is a graph showing an example of the relationship between the ambient temperature, and the pulse width of the driving voltage with reference to the second operation.

Next, an example of the driving voltage controlled by the second operation is described with reference to FIG. 6. Herein, the present description is based on the premise that the scanning electrode driving voltage Vcom and the signal electrode driving voltage Vseg, serving as the driving voltage, has the pulse width or the pulse height, variable according to temperature, however, with the present embodiment, the temperature compensation is executed by varying the pulse width. In FIG. 6, the X-axis indicates detected temperature, and the Y-axis indicates the pulse width of the driving voltage (namely, the composite driving voltage obtained by merging the scanning electrode driving voltage Vcom with the signal electrode driving voltage Vseg) during the select time period Se (refer to FIG. 13).

Herein, the predetermined temperature T at the boundary between the first temperature compensation range, and the second temperature compensation range is preferably not higher than 0° C. from the viewpoint of the characteristics of the liquid crystal panel 2 with the memory effect, and is assumed at about −2° C. in this case. If the detected temperature is higher the predetermined temperature T (about −2° C.), the detected temperature falls in the first temperature compensation range as shown in the figure, and if the detected temperature is lower than the predetermined temperature T (about −2° C.), the detected temperature falls in the second temperature compensation range.

Now, in the case where the detected temperature found by the temperature sensor 3 is in the first temperature compensation range, the pulse width of the driving voltage increases from the high temperature side toward the low temperature side, along the temperature characteristics of the threshold value of the liquid crystal panel 2 with the memory effect as with the case shown in FIGS. 3 and 4, respectively, omitting therefore description thereof.

If the detected temperature found by the temperature sensor 3 is turned to the predetermined temperature T or lower, the reset pulse is outputted from the driving circuit 10 at a point R in FIG. 6, as described with reference to the flow chart of FIG. 5, whereupon the liquid crystal panel 2 with the memory effect turns off display content to thereby exhibit the black display. Since the supply of the driving voltage is stopped after the reset pulse is outputted, power consumption becomes very small while the display of the liquid crystal panel 2 with the memory effect remains maintaining black display.

As a result of the operation described as above, the liquid crystal panel 2 with the memory effect is reset if the detected temperature is on the lower temperature side of the predetermined temperature T, so that it is possible to implement a highly reliable liquid crystal device capable of avoiding erroneous operation even if there is the risk of the device entering the abnormal operation region in the second temperature compensation range. With the example concerning the second operation, as described with reference to FIG. 6, the liquid crystal panel 2 with the memory effect is reset immediately upon entering the second temperature compensation range to thereby stop display operation, so that it follows that the second temperature compensation range does not, in effect, exist.

Figure 7:
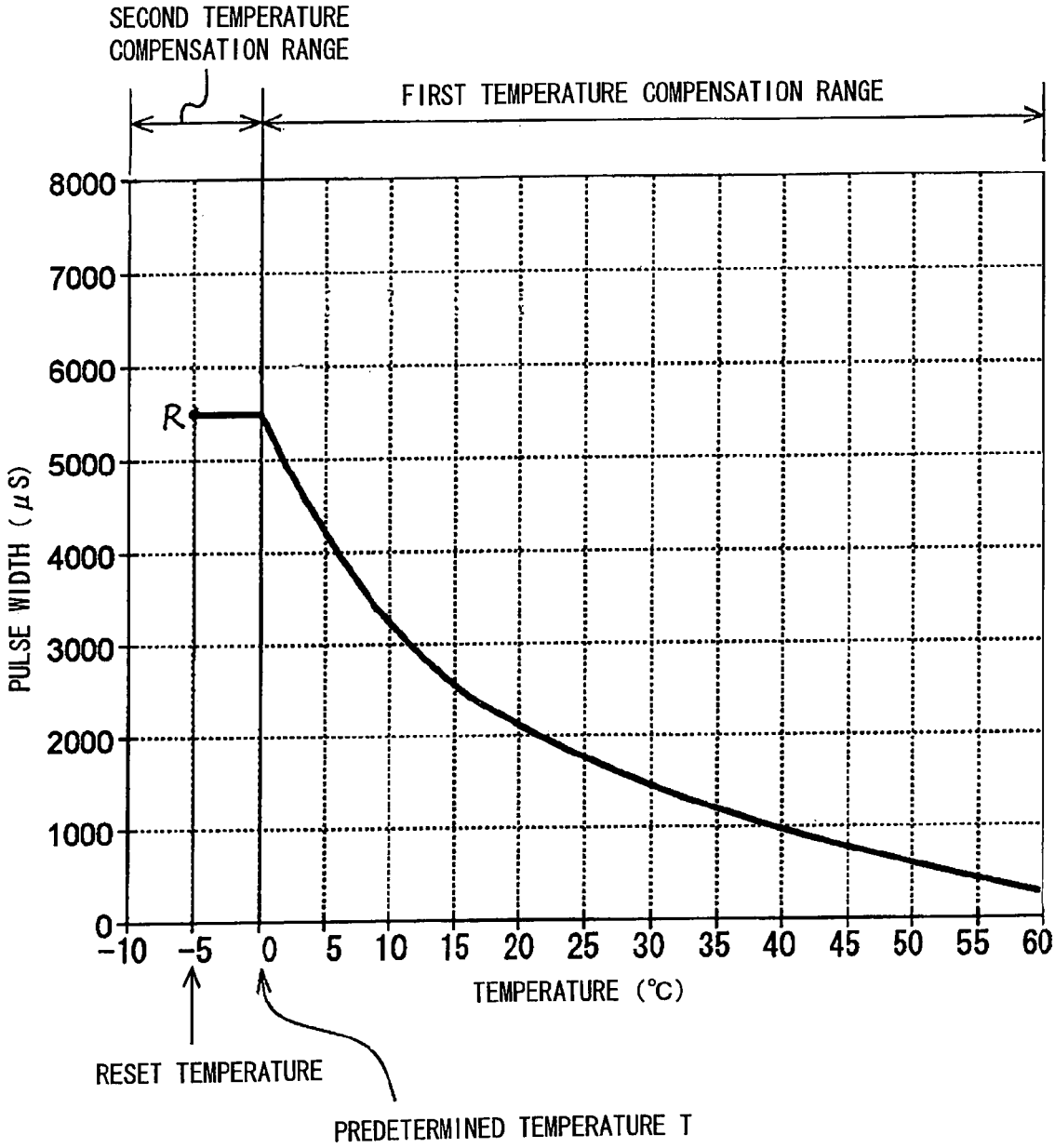
FIG. 7 is a graph showing another example of the relationship between the ambient temperature, and the pulse width of the driving voltage with reference to the second operation.

Next, referring to FIG. 7, there is described another example of the temperature compensation by the pulse width of the driving voltage in the case where the second operation (refer to the flow chart of FIG. 5) according to the present embodiment is applied. In this case, the premise on which the description is given, the X-axis, the Y-axis, the predetermined temperature T at the boundary between the first temperature compensation range and the second temperature compensation range, and so forth are the same as those in the case of the example described with reference to FIG. 6.

In this case, if the detected temperature found by the temperature sensor 3 shown in FIG. 1 is in the first temperature compensation range, the pulse width of the driving voltage increases from the high temperature side toward the low temperature side, along the temperature characteristics of the threshold value of the liquid crystal panel 2 with the memory effect, as with the case shown in FIG. 6, omitting therefore description thereof.

If the detected temperature found by the temperature sensor 3 is turned to the predetermined temperature T or lower, and falls in the second temperature compensation range, the pulse width of the driving voltage becomes substantially equal to a maximum pulse width reached at the predetermined temperature T. Pulse width values in the second temperature compensation range are decided by referring to the pulse width table for the second temperature compensation range, stored in the memory of the control circuit 11. And when the detected temperature found by the temperature sensor 3 is an optional temperature (for example, −5° C.) on the lower temperature side of the predetermined temperature T, the reset pulse is outputted from the driving circuit 10 at a point R in FIG. 7, whereupon the liquid crystal panel 2 with the memory effect turns off display content to thereby exhibit the black display state.

As a result of the operation described as above, the liquid crystal panel 2 with the memory effect is able to secure a given operational margin in the second temperature compensation range on the lower temperature side of the predetermined temperature T, thereby executing stable operation. Further, if the detected temperature is turned to an optional temperature further lower than the predetermined temperature T, the liquid crystal panel 2 with the memory effect is reset, so that it is possible to implement a highly reliable liquid crystal device capable of avoiding erroneous operation even if there is the risk of the device entering the abnormal operation region in the second temperature compensation range. Further, the pulse width of the driving voltage, in the second temperature compensation range, is assumed substantially equal to the maximum pulse width reached at the predetermined temperature T, however, the pulse width of the driving voltage is not limited thereto, and may be controlled so as to become smaller following the drop in temperature as shown in FIG. 4. By so doing, it becomes possible to increase an operational margin to thereby execute more stable operation.

Thus, according to the first embodiment of the invention, the temperature characteristics of the liquid crystal panel with the memory effect, in the first temperature compensation range where the ambient temperature is not lower than the predetermined temperature T, are compensated for by varying the pulse with or the pulse height of the driving voltage while the temperature compensation is carried out by taking into consideration the humidity characteristics of the liquid crystal panel with the memory effect in the second temperature compensation range on the lower temperature side of the predetermined temperature T, thereby rendering it possible to provide a liquid crystal device low in power consumption, capable of executing stable operation in spite of temperature variation and humidity variation.

Further, if there is the risk of the liquid crystal device entering the abnormal operation region, erroneous operation can be avoided by resetting the liquid crystal panel 2 with the memory effect, thereby enhancing reliability of the liquid crystal device.

With the first embodiment, the stable operation is implemented by use of the temperature sensor 3 only, which can contribute to reduction in the cost as well as the size of the liquid crystal device.

Second Embodiment

Now, a second embodiment of a liquid crystal device according to the invention is described with reference to FIGS. 8 to 10. The second embodiment has a feature such that a temperature sensor, together with a humidity sensor for detection of an ambient humidity, is installed, thereby avoiding occurrence of erroneous operation at low temperature and low humidity with high reliability. Constituent elements of the liquid crystal device according to the present embodiment, identical to those shown in the first embodiment, are denoted by like reference numerals, partially omitting duplicated description.

Figure 8:
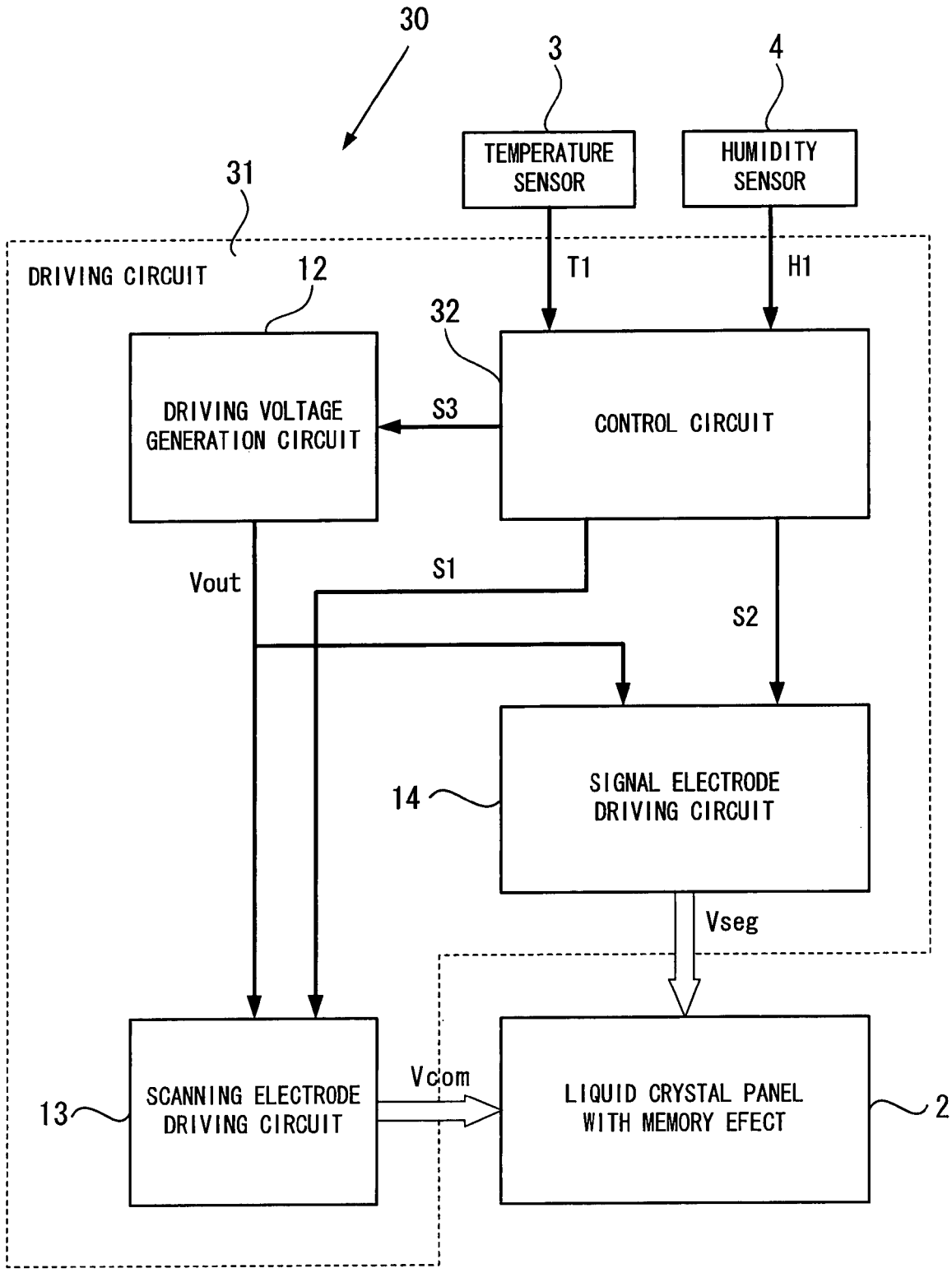
FIG. 8 is a block diagram showing a configuration of a second embodiment of a liquid crystal device according to the invention.

FIG. 8 is a block diagram showing a configuration of the second embodiment of the liquid crystal device according to the invention. In FIG. 8, reference numeral 30 denotes the liquid crystal device according to the second embodiment. The liquid crystal device 30 comprises a liquid crystal panel 2 with a memory effect, a temperature sensor 3, a humidity sensor 4, and a driving circuit 31.

In this case, the liquid crystal panel 2 with the memory effect is composed of ferroelectric liquid crystal device exhibiting the smectic phase as with the case of the first embodiment. A general electronic type hygrometer (electronic sensor using resistive element) can be used as the humidity sensor, and the humidity sensor 4 detects an ambient humidity of the liquid crystal device 30, outputting a humidity detection signal H1 as humidity information. For the humidity sensor 4, use can be made of a common electronic humidity indicator (an electronic sensor employing a resistor), and so forth. The driving circuit 31 comprises a control circuit 32, a driving voltage generation circuit 12, a scanning electrode driving circuit 13, and a signal electrode driving circuit 14.

The control circuit 32 is for controlling the liquid crystal device 30 in whole, and is preferably made up of a microcomputer, but may be made up of a custom IC using random logic, and so forth. The control circuit 32 receives a temperature detection signal T1 and the humidity detection signal H1, outputting control signals S1, S2, S3, respectively. A configuration of the second embodiment, in other respects, is the same as that for the first embodiment, omitting therefore description thereof.

Next, a first operation of the liquid crystal device 30 according to the second embodiment is described with reference to a flow chart of FIG. 9. The first operation has a feature such that erroneous operation in the vicinity of the boundary of the abnormal operation region is predicted with high precision on the basis of the temperature information from the temperature sensor 3, and the humidity information from the humidity sensor 4, thereby avoiding the erroneous operation. Further, the present description is based on the premise that the liquid crystal device 30 is the display device for effecting display of time and so forth by means of the liquid crystal panel 2 with the memory effect.

Figure 9:
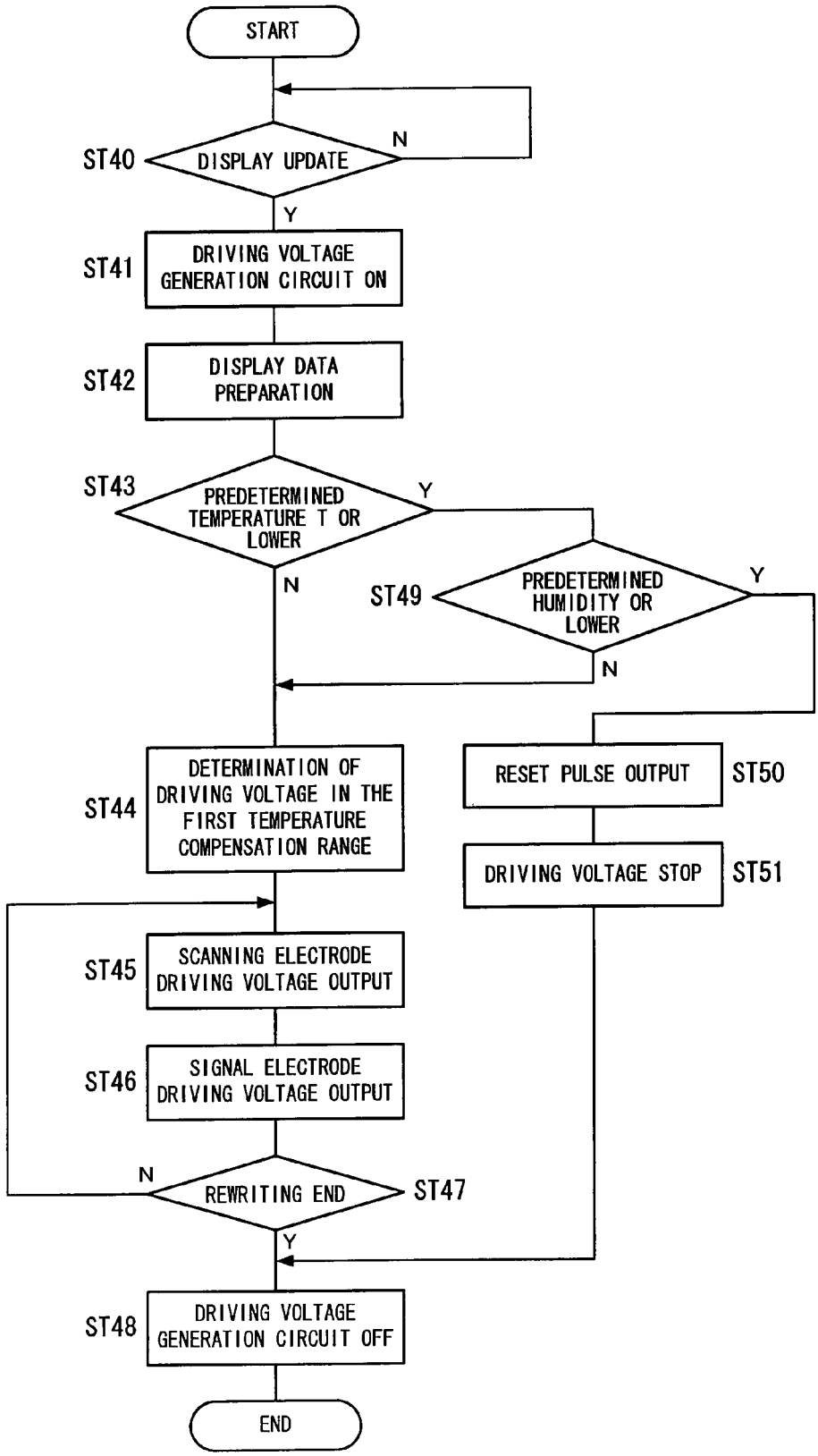
FIG. 9 is a flow chart showing a first operation of a driving circuit of the liquid crystal device.

With reference to the flow chart of FIG. 9, first, in step ST40, the control circuit 32 made up of the microcomputer, and so forth, incorporated in the driving circuit 31, determines whether to update a display on the liquid crystal panel 2 with the memory effect or not. Now, for updating display content, in the case of the liquid crystal device 30 being, for example, the display device for indicating a digital time in hours and minutes, as with the case of the first embodiment, it is necessary to update the display when time advances at places for minutes. It is also necessary to update the display, for example, in the case of a user switching a display mode by actuating a switch (not shown), and so forth. If the control circuit 32 makes a determination Yes in the step ST40, the operation proceeds to the next step ST41 while if the determination is No, the operation reverts to the step ST40, holding a standby state until updating of the display.

Thereafter, in the case where the determination for updating the display is made, processing by the control circuit 11, in respective steps from the step ST41 to step ST43, is identical to that in the respective steps from the step ST2 to the step ST4 in the flow chart of FIG. 2, describing the first operation by the control circuit 11 according to the first embodiment, previously described with reference to FIG. 1, omitting therefore description thereof.

In the step ST43, the control circuit 32 determines whether a detected temperature found by the temperature sensor 3 is at the predetermined temperature T or lower, or not, and if the detected temperature is higher than the predetermined temperature T, the control circuit 32 makes a determination No, and the operation proceeds to the step ST44. If the detected temperature found by the temperature sensor 3 is at the predetermined temperature T or lower, the control circuit 32 makes a determination Yes, and the operation proceeds to a step ST49.

In the step ST44, the control circuit 32 makes a decision on a pulse width or a pulse height of the scanning electrode driving voltage Vcom and the signal electrode driving voltage Vseg, respectively, according to the temperature information as detected, by referring to the pulse width table or the pulse height table, for the first temperature compensation range, as pre-stored in the memory.

Thereafter, processing by the control circuit 32, in respective steps from step ST45 to step ST48, is identical to that in the respective steps from the step ST 7 to the step ST10, in the flow chart of FIG. 2, describing the first operation by the control circuit 11 according to the first embodiment, previously described with reference to FIG. 1, omitting therefore description thereof.

Next, there is described the operation proceeding to the step ST49 upon the control circuit 32 making the determination Yes in the step ST 43.

In the step ST49, the control circuit 32 receives the humidity detection signal H1 as an analog signal from the humidity sensor 4 to thereby covert the analog signal into digital humidity information through an internal A/D converter (not shown) before comparing the digital humidity information with a predetermined humidity as preset, thereby determining whether or not a detected humidity is at the predetermined humidity or lower.

Herein, the predetermined humidity is preferably a humidity at which there arises the risk that the operation of the liquid crystal panel 2 with the memory effect enters the abnormal operation region at the time of low temperature. If determination No is made in the step ST49, the operation proceeds to the step ST44 while if determination Yes is made, the operation proceeds to step ST50. If the detected humidity is higher than the predetermined humidity, and the operation proceeds to the step ST44, subsequent steps of processing are identical to the steps corresponding thereto, in the case of the operation proceeding from the step ST43 to the step ST44, omitting therefore description thereof.

If the detected humidity is lower than the predetermined humidity, and the operation proceeds from the step ST49 to the step ST50, the control circuit 32 outputs the control signals S1, S2 to control the scanning electrode driving circuit 13, and the signal electrode driving circuit 14, respectively, thereby causing a reset pulse to be outputted by the scanning electrode driving voltage Vcom and the signal electrode driving voltage Vseg, respectively. The reset pulse is the same as the reset pulse (refer to FIG. 13) bidirectionally outputted in the switching time period Sw of the reset time period Rs for setting all the pixels in the black display state. By the agency of the reset pulse, the liquid crystal panel 2 with the memory effect turns off display content to thereby exhibit the black display.

Next, in step ST51, the control circuit 32 controls the scanning electrode driving circuit 13, and the signal electrode driving circuit 14, by the agency of the control signals S1, S2, respectively, so as to stop outputting the scanning electrode driving voltage Vcom and the signal electrode driving voltage Vseg, thereby stopping application of the driving voltage to the liquid crystal panel 2 with the memory effect. Thereafter, the control circuit 32 executes the operation in the step ST48, thereby completing display operation.

Now, after completion of the operation in the step ST48, the control circuit 32 falls in pause state, and the driving voltage generation circuit 12, the scanning electrode driving circuit 13 and the signal electrode driving circuit 14 are all in pause state, whereupon supply of the driving voltage to the liquid crystal panel 2 with the memory effect is stopped, so that power consumption during a time period of the pause becomes very small. However, with the liquid crystal panel 2 with the memory effect, the reset display state can be maintained owing to the memory effect even if the supply of the driving voltage thereto is stopped.

Variation dependent on the temperature, in the pulse width of the driving voltage controlled by the first operation according to the second embodiment, shown in the flow chart of FIG. 9, is the same as that in the case of the example shown in FIG. 6 with reference to the first embodiment. More specifically, if the detected temperature is in the first temperature compensation range at the predetermined temperature T or higher, or the detected humidity is in the first temperature compensation range at the predetermined humidity or higher, the pulse width of the driving voltage increases from the high temperature side toward the low temperature side along the temperature characteristics of the threshold value of the liquid crystal panel 2 with the memory effect, reaching its maximum at the predetermined temperature T.

However, if the detected temperature is lower than the predetermined temperature T and the detected humidity is lower than the predetermined humidity, the reset pulse is outputted, whereupon the liquid crystal panel 2 with the memory effect turns off display content to thereby exhibit the black display. As a result, the liquid crystal panel 2 with the memory effect is reset on the basis of the temperature information, and the humidity information, so that erroneous operation in the vicinity of the abnormal operation region can be predicted with high precision, and the erroneous operation can be thereby avoided, rendering it possible to provide a highly reliable liquid crystal device without the risk of erroneous operation.

Next, a second operation of the liquid crystal device 30 according to the second embodiment is described with reference to a flow chart of FIG. 10. The second operation has a feature such that erroneous operation in the vicinity of the abnormal operation region is predicted with high precision by focusing attention on the fact that the abnormal operation region is prone to occur when a low humidity condition has continuously lasted for a predetermined time length, thereby avoiding the erroneous operation. Further, the present description is based on the premise that the liquid crystal device 30 is a display device for effecting display of time and so forth by means of the liquid crystal panel 2 with the memory effect.

Figure 10:
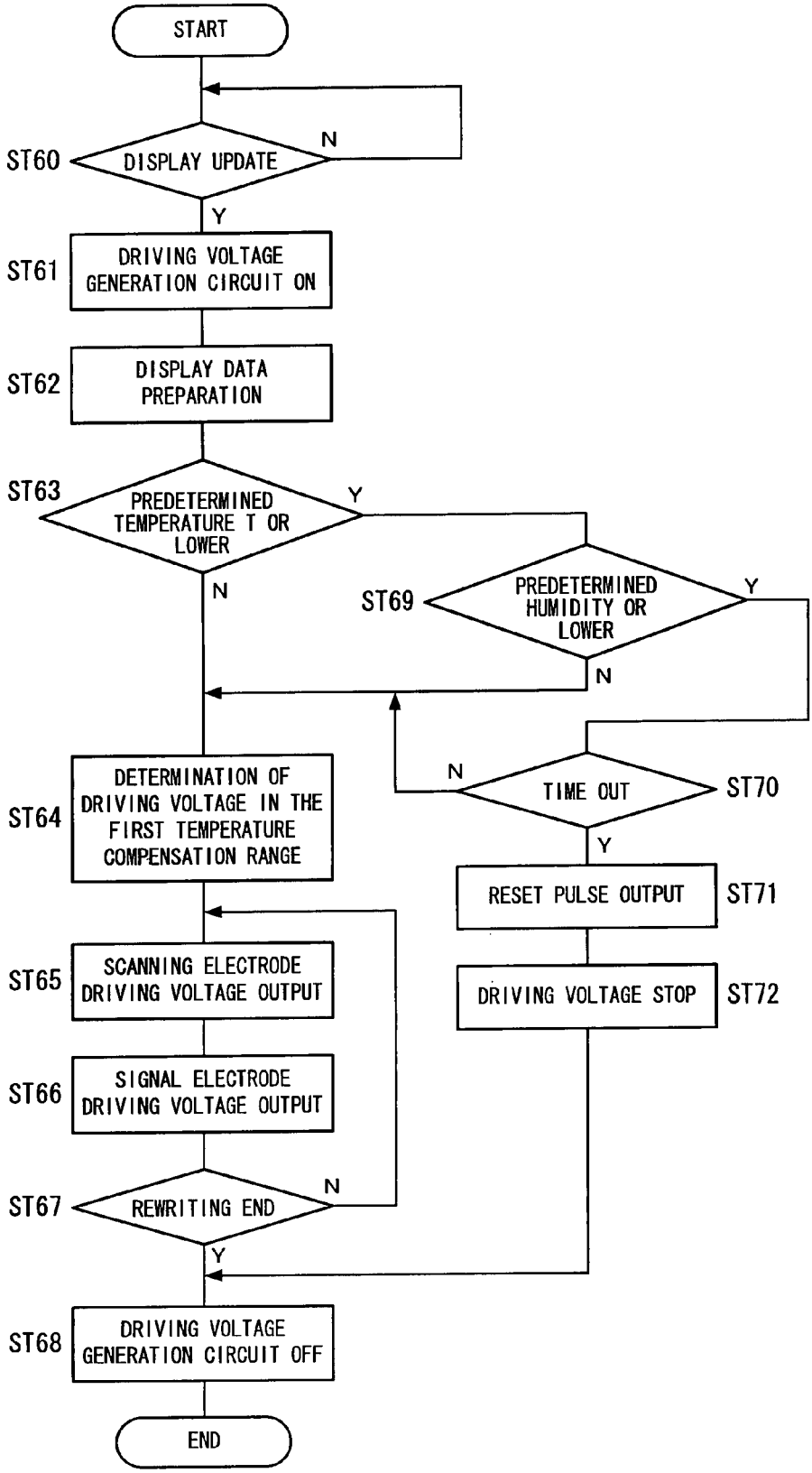
FIG. 10 is a flow chart showing a second operation of the driving circuit of the liquid crystal device.

In the flow chart of FIG. 10, processing by the control circuit 32, in steps ST 60 to ST62, respectively, is identical to that in the steps ST2 to ST3, respectively, shown in the flow chart of FIG. 2, describing the first operation by the control circuit 11 shown in FIG. 1, with reference to the first embodiment, omitting therefore description thereof.

In step ST63, the control circuit 32 receives the temperature detection signal T1 as an analog signal from the temperature sensor 3 to thereby covert the analog signal into digital temperature information through an internal A/D converter (not shown) and subsequently, compare the digital temperature information with the predetermined temperature T as preset, thereby determining whether a detected temperature is at the predetermined temperature T or lower, or not.

In this case, the predetermined temperature T refers to a temperature at which there exists a likelihood of the liquid crystal panel 2 with the memory effect entering the abnormal operation region at low humidity, and is preferably not higher than 0° C. If the control circuit 32 makes a determination No in the step ST63, the operation proceeds to step ST64 while if determination Yes is made, the operation proceeds to step ST69.

Processing executed by the control circuit 32, in respective steps from step ST65 to step ST68, after proceeding to the step ST64, is identical to that in the respective steps from the step ST7 to the step ST10 in the flow chart of FIG. 2, describing the first operation by the control circuit 11 shown FIG. 1 with reference to the first embodiment, omitting therefore description thereof.

Next, there is described the operation in the case of the control circuit 32 making the determination Yes in the step ST63, and the operation proceeding to the step ST69.

In the step ST69, the control circuit 32 receives the humidity detection signal H1 as the analog signal from the humidity sensor 4 to thereby covert the analog signal into the digital humidity information through the internal A/D converter (not shown) before comparing the digital humidity information with the predetermined humidity as preset, thereby determining whether a detected humidity is at the predetermined humidity or lower, or not.

Herein, the predetermined humidity is a humidity at which there arises the risk that the liquid crystal panel 2 with the memory effect enters the abnormal operation region at the time of low temperature. If the determination No is made in the step ST69, the operation proceeds to the step ST64 while if determination Yes is made, the operation proceeds to step ST70.

If the detected humidity is higher than the predetermined humidity, and the operation proceeds to the step ST64, subsequent steps of processing are identical to the steps corresponding thereto, in the case of the operation proceeding from the step ST63 to the step ST64, omitting therefore description thereof.

If the detected humidity is at the predetermined humidity or lower, and the operation proceeds from the step ST69 to the step ST70, the control circuit 32 determines whether or not a condition of the detected humidity being at the predetermined humidity or lower has continuously lasted for the predetermined time length (time out). If the determination No is made in this step, the operation proceeds to the step ST64 while if determination Yes is made in this step, the operation proceeds to step ST71.

In the case where the condition of the detected humidity being at the predetermined humidity or lower has not continuously lasted for the predetermined time length (time out), and the operation has proceeded from the step ST70 to the step ST64, respective steps of processing, subsequent thereto, are identical to the respective steps following the operation proceeding from the step ST63 to the step ST64, omitting therefore description thereof.

In the case where the condition of the detected humidity being at the predetermined humidity or lower has continuously lasted for the predetermined time length (time out), and the operation has proceeded from the step ST70 to the step ST71, the control circuit 32 outputs the control signals S1, S2 to control the scanning electrode driving circuit 13, and the signal electrode driving circuit 14, respectively, thereby causing a reset pulse to be outputted by the scanning electrode driving voltage Vcom and the signal electrode driving voltage Vseg, respectively. The reset pulse is the same as the reset pulse (refer to FIG. 13) bidirectionally outputted in the switching time period Sw of the reset time period Rs for setting all the pixels in the black display state. By the agency of the reset pulse, the liquid crystal panel 2 with the memory effect turns off display content to thereby exhibit the black display.

Thereafter, in step ST72, the control circuit 32 controls the scanning electrode driving circuit 13, and the signal electrode driving circuit 14, by the agency of the control signals S1, S2, respectively, so as to stop outputting the scanning electrode driving voltage Vcom and the signal electrode driving voltage Vseg, thereby stopping application of the driving voltage to the liquid crystal panel 2 with the memory effect. Then, the control circuit 32 executes the operation in the step ST68, thereby completing display operation.

Now, after completion of the operation in the step ST68, the control circuit 32 falls in the pause state, and the driving voltage generation circuit 12, the scanning electrode driving circuit 13 and the signal electrode driving circuit 14 are all in the pause state, whereupon supply of the driving voltage to the liquid crystal panel 2 with the memory effect is stopped, so that power consumption during the time period of the pause becomes very small. However, with the liquid crystal panel 2 with the memory effect, the reset display state can be maintained owing to the memory effect even if the supply of the driving voltage thereto is stopped.

Variation dependent on the detected temperature, in pulse width of the driving voltage controlled by the second operation according to the second embodiment, shown in the flow chart of FIG. 10, is the same as that in the case of the example shown in FIG. 6 with reference to the first embodiment. More specifically, if the detected temperature is at the predetermined temperature T or higher or if the condition of the detected humidity being at the predetermined humidity or lower does not last for the predetermined time length, the pulse width of the driving voltage will fall in the first temperature compensation range where, and will increase from the high temperature side toward the low temperature side, reaching its maximum at the predetermined temperature T. However, if the detected temperature is lower than the predetermined temperature T, and the condition of the detected humidity being at the predetermined humidity or lower has continuously lasted for the predetermined time length, the reset pulse is outputted, whereupon the liquid crystal panel 2 with the memory effect turns off the display content to thereby exhibit the black display.

As a result, the liquid crystal panel 2 with the memory effect is reset on the basis of the temperature information, and the humidity information in the case where a low humidity condition has continuously lasted, so that erroneous operation in the vicinity of the abnormal operation region can be predicted with still higher precision, and the erroneous operation can be thereby avoided, rendering it possible to provide a highly reliable liquid crystal device without the risk of erroneous operation.

Thus, with the second embodiment of the invention, it is possible to predict the erroneous operation in the vicinity of the abnormal operation region with high precision by use of the temperature information from the temperature sensor together with the humidity information from the humidity sensor, thereby avoiding the erroneous operation. Accordingly, with the second embodiment, the highly reliable liquid crystal device without the risk of the erroneous operation can be provided although the second embodiment requires the humidity sensor as well as the temperature sensor.

Further, with the second embodiment, a prerequisite for outputting the reset pulse is determined on the basis of two kinds of information, that is, the temperature information, and the humidity information, however, the invention is not limited to such a configuration. For example, the humidity sensor only may be installed, and the reset pulse may be outputted if the condition of the detected humidity being at the predetermined humidity or lower has continuously lasted on the basis of the humidity information, thereby avoiding the erroneous operation.

Still further, with the embodiments described hereinbefore, compensation for the temperature characteristics and humidity characteristics, by the driving voltage according to the invention, is carried out by varying the pulse width of the driving voltage, however, the invention is not limited thereto, and the compensation may alternatively be carried out by varying the pulse height of the driving voltage, or by varying both the pulse width and the pulse height.

Yet further, it is to be understood that the invention is not limited to the configuration in the block diagrams, and processing in the flow charts, shown with reference to the respective embodiments of the invention and that various changes and modifications may be made thereto without departing from the spirit and scope of the invention. Further, with the embodiments described hereinbefore, it has been described that the liquid crystal panel with a memory effect, in the liquid crystal device, is used as a display panel, but the invention is not limited thereto, and the liquid crystal panel with a memory effect can be applied to a liquid crystal device such as a liquid crystal shutter, and so forth.

What is claimed is:

1. A liquid crystal device capable of executing temperature compensation, comprising a liquid crystal panel with a liquid crystal layer sandwiched between a pair of substrates having respective driving electrodes and alignment layers formed by inorganic vapor-deposited films made of SiOx, over respective surfaces of the substrates, opposed to each other, a driving circuit for outputting a driving voltage for driving the liquid crystal panel, and a temperature sensor for detecting an ambient temperature:

the driving circuit including a control circuit for varying a pulse width or a pulse height of the driving voltage;

the control circuit including a first temperature compensation range where the pulse width or the pulse height of the driving voltage is increased from a high temperature side toward a low temperature side in a temperature compensation range of the liquid crystal panel, according to temperature information detected by the temperature sensor, and a second temperature compensation range where the pulse width or the pulse height of the driving voltage is rendered maximum at a predetermined temperature not higher than 0° C. at a boundary between the first temperature compensation range, and the second temperature compensation range before the pulse width or the pulse height of the driving voltage is rendered substantially equal to, or smaller than a maximum pulse width or a maximum pulse height of the driving voltage, on a side of the boundary, lower than the predetermined temperature, wherein the liquid crystal layer is composed of ferroelectric liquid crystals with a memory effect having at least two stable states, the driving circuit outputs a reset pulse to reset the liquid crystal panel into one of the stable states when a temperature detected by the temperature sensor is turned to the predetermined temperature or lower than the predetermined temperature.

2. The liquid crystal device according to claim 1, wherein the temperature compensation range including the first temperature compensation range and second temperature compensation range is in a range of −10° C. to +60° C.

3. The liquid crystal device according to claim 1, wherein the driving voltage outputted by the driving circuit contains a reset pulse for resetting the liquid crystals with a memory effect to one of the two stable states, and outputs the reset pulse sufficient for resetting the liquid crystals with a memory effect to the one of the two stable states in the second temperature compensation range.

4. The liquid crystal device according to claim 3, wherein the driving circuit outputs the reset pulse sufficient for resetting the liquid crystals with a memory effect to the one of the two stable states at any suitable temperature in the second temperature compensation range.

5. The liquid crystal device according to claim 3, wherein the liquid crystal device further comprises a humidity sensor for detecting an ambient humidity, and the driving circuit outputs the reset pulse sufficient for resetting the liquid crystals with a memory effect to the one of the two stable states in the second temperature compensation range on the basis of humidity information detected by the humidity sensor.

6. The liquid crystal device according to claim 5, wherein the humidity information detected by the humidity sensor is information on humidity at a predetermined humidity or lower.

7. The liquid crystal device according to claim 5, wherein the humidity information detected by the humidity sensor is information on continuation of a condition of the detected humidity being at a predetermined humidity or lower for a predetermined time length.

8. The liquid crystal device according to claim 3, wherein the driving circuit stops the driving voltage applied to the liquid crystal panel with a memory effect after the liquid crystal panel with a memory effect is reset.

9. The liquid crystal device according to claim 8, wherein the liquid crystal device further comprises a humidity sensor for detecting an ambient humidity, and the driving voltage circuit stops the driving voltage applied to the liquid crystal panel with a memory effect according to the humidity information detected by the humidity sensor.

10. The liquid crystal device according to claim 9, wherein the humidity information detected by the humidity sensor is information on humidity at a predetermined humidity or lower.

11. The liquid crystal device according to claim 9, wherein the humidity information detected by the humidity sensor is information on continuation of a condition of the detected humidity being at a predetermined humidity or lower for a predetermined time length.

12. The liquid crystal device according to claim 1, wherein the ferroelectric liquid crystals with a memory effect is composed of liquid crystals exhibiting the smectic phase.

* * * * *